US006673506B2

(12) United States Patent
Nakanishi et al.

(10) Patent No.: US 6,673,506 B2
(45) Date of Patent: Jan. 6, 2004

(54) TONER PRODUCTION PROCESS

(75) Inventors: Tsuneo Nakanishi, Chiba (JP); Hirohide Tanikawa, Shizuoka (JP); Tsutomu Onuma, Kanagawa (JP); Nobuyuki Okubo, Kanagawa (JP); Kaori Hiratsuka, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/014,417

(22) Filed: Dec. 14, 2001

(65) Prior Publication Data

US 2002/0182528 A1 Dec. 5, 2002

(30) Foreign Application Priority Data

Dec. 15, 2000 (JP) ..... 2000-381180
Sep. 28, 2001 (JP) ..... 2001-298916

(51) Int. Cl.[7] ..... G03G 9/087
(52) U.S. Cl. ..... 430/137.18; 241/24.28; 430/137.2
(58) Field of Search ..... 430/137.2; 241/24.28, 241/137.18

(56) References Cited

U.S. PATENT DOCUMENTS 4,884,820 A * 12/1989 Jackson et al. ..... 277/53
5,341,602 A * 8/1994 Foley ..... 51/2 R
5,547,797 A * 8/1996 Anno et al. ..... 430/106.6

FOREIGN PATENT DOCUMENTS

| | | |
|---|---|---|
| JP | 41-20153 | 11/1966 |
| JP | 42-27596 | 12/1967 |
| JP | 44-6397 | 3/1969 |
| JP | 51-14278 | 2/1976 |
| JP | 59-24855 | 2/1984 |
| JP | 59-105853 | 6/1984 |
| JP | 7-155628 | 6/1995 |
| JP | 11-221480 | 8/1999 |
| JP | 3015489 | 12/1999 |

* cited by examiner

*Primary Examiner*—John Goodrow
(74) *Attorney, Agent, or Firm*—Fitzpatrick, Cella, Harper & Scinto

(57) ABSTRACT

In a toner production process having at least a kneading step, a pulverization step using a mechanical grinding machine, and a classification step, the grinding means comprises a mechanical grinding machine having at least a rotor which is a rotator attached to the center rotating shaft and a stator which is provided around the rotor, keeping a constant gap between the stator and the rotor surface, the grinding machine being so constructed that a circular space formed by keeping the gap stands airtight, and the surface of at least one of the rotor and the stator is coated by the plating of a chromium alloy containing at least chromium carbide.

24 Claims, 7 Drawing Sheets

TONER PRODUCTION PROCESS

BACKGROUND OF THE INVENTION

1. Field of the Invention

This invention relates to a process for producing a toner used in image-forming processes such as electrophotography, electrostatic recording, electrostatic printing and toner jet recording.

2. Related Background Art

In image-forming processes such as electrophotography, toners for developing electrostatic latent images are used. Processes for producing such toners are roughly grouped into a pulverization process and a polymerization process. The pulverization process is available as a simple and popular production process. As a common production method therefor, a binder resin for the fixing to transfer mediums and a colorant for bringing out the color as a toner are used, to which a charge control agent for imparting electric charges to toner particles, a magnetic material for imparting transport properties to the toner itself, and additives such as a releasing agent and a fluidity-providing agent are optionally added, and these are mixed and melt-kneaded, then the kneaded product formed is cooled to solidify and thereafter pulverized by a fine-grinding means, optionally followed by classification to provide the desired particle size distribution and further addition of a fluidity-providing agent to produce a toner used for image formation. Also, in the case of toners used in two-component development, the above toner is blended with a magnetic carrier of various types, and the developer obtained is used for image formation.

As means for pulverization, various grinding machines are used. A jet mill, in particular, an impact jet mill, making use of an air jet as shown in FIG. 5 is often used. In the impact jet mill, a powder material is transported with a high-pressure gas such as an air jet and is jetted from an outlet of an acceleration tube and caused to collide against the collision surface of a colliding member so provided as to face the opening plane of the outlet of the acceleration tube, to pulverize the powder material by the impact force thus produced.

In the impact jet mill shown in FIG. 5, a colliding member 164 is so provided as to face an outlet 163 of an acceleration tube 162 to which a high-pressure gas feed nozzle 161 is connected. By the aid of high-pressure gas fed to the acceleration tube 162, a pulverizing material is sucked into the acceleration tube 162 from a pulverizing material feed opening 165 made to communicate with the acceleration tube 162 at its middle portion, thus the pulverizing material is jetted together with the high-pressure gas and caused to collide against a collision surface 166 of the colliding member 164. The material is pulverized by the impact thereby produced, and the resultant pulverized product is discharged from a pulverized-product discharge outlet 167.

In the above impact jet mill, however, a large quantity of air (high-pressure gas) is required in order to produce toners with small particle diameter. Hence, the apparatus requires a very large power consumption, and has a problem in respect of energy cost. In particular, in recent years, it is sought to achieve the energy saving of apparatus so as to cope with environmental problems.

As a countermeasure therefor, as a grinding machine which is more efficient than the jet mill in respect of energy, a rotary mechanical grinding machine as shown in FIG. 1 is used, which is disclosed in, e.g., Japanese Patent Application Laid-Open Nos. 59-24855 and 59-105853 and Japanese Patent Publication No. 3-15489. In this rotary mechanical grinding machine, the powder material is pulverized by introducing it to a circular space formed between a rotor which rotates at a high speed and a stator disposed around the rotor. According to this rotary mechanical grinding machine, the powder material can be pulverized at an energy much more saved than the jet mill, and moreover may be less over-pulverized, so that any fine powder or ultrafine powder may less occur, making it possible to improve yield.

Taking note of the shapes of toner particles obtained by pulverization using these grinding machines, it is known that the toner particles obtained by the jet mill have an amorphous (lacking definite form) and angular shape and that the toner particles obtained by the rotary mechanical grinding machine have a roundish shape. This is considered due to the difference in the manner of pulverization. More specifically, this is because, in the pulverization utilizing the air jet, the greater part of the powder material is pulverized by collision of particles one another or by their collision against the colliding member, whereas, in the pulverization using the rotary mechanical grinding machine, the greater part of the powder material is pulverized by collision of particles against the wall surfaces of the rotor and liner which rotate at a high speed. Also, in the rotary mechanical pulverization, the pulverization not a little causes heat generation to bring about an additional effect of being made spherical due to heat, so that the toner particles obtained by this pulverization may have a roundish shape, as so considered.

Hence, the toner particles obtained by pulverization using the rotary mechanical grinding machine have a smaller specific surface area than the toner particles obtained by pulverization using the jet mill, and hence have a good fluidity, also having so small voids between particles that they have superior packing properties and can afford addition of external additives in a small quantity. The former has such advantages. There may also an additional advantage on product quality such that the former has superior chargeability and transfer performance. Namely, the rotary mechanical grinding machine enables production of good-quality toners at a saved energy and in a high yield.

However, mechanical grinding machines including such a high-speed rotary fine grinding machine have caused problems that their continuous use or any inorganic matter contained in toner particles may make grinding surfaces of the grinding machine wear to cause a lowering of pulverization capacity, a change in quality of the pulverized product or a lowering of reliability because of inclusion of wear residues. What the grinding surfaces refer are the outer periphery surface of the rotor and the inner periphery surface of the stator. Thus, there has been no choice but changing for new ones where the surfaces have worn.

Especially in recent years, it has become general to use magnetic toners as one-component developers on account of their convenience. When such magnetic toners are produced by pulverization using the above rotary mechanical grinding machine, the surfaces of the rotor and stator may wear markedly faster than when toners containing no magnetic materials are produced. As the grinding surfaces wear, the shape of toner particles tends to become non-uniform and it becomes difficult to produce toner particles stably, so that the rotor and the stator may have so short lifetime that they must frequently be changed for new ones, resulting in an increase of product cost.

Accordingly, in order to make the rotor and stator have surfaces improved in wear resistance, it is attempted to treat their base members by quenching, carburizing or nitriding. There, however, are problems that the layer thus hardened has a small thickness and that the treatment is made at so high a temperature as to cause strain. Also, the surface hardness is not so high, and has been insufficient for the wear resistance required especially when magnetic-toner materials are pulverized.

It has also been attempted to coat base member surfaces of the rotor and stator with a ceramic material by spray coating. However, the coating layers formed tend to peel off and has been insufficient for maintaining the wear resistance.

Japanese Patent Application Laid-Open Nos. 7-155628 and 11-221480 disclose a method in which the base member surfaces of the rotor and stator are treated by lining with a titanium material to improve their wear resistance. This method certainly has an advantage that a high surface hardness can be achieved, but has had a problem that gaps tend to be made at the time of lining treatment to tend to cause peeling or cracking. It also has had a problem that materials for surface treatment are expensive.

SUMMARY OF THE INVENTION

An object of the present invention is to provide a toner production process which has solved the above problems and can produce a toner in a high throughput and a high yield.

Another object of the present invention is to provide a process for producing a toner which has good developing performance and transfer performance even in a high-temperature high-humidity environment and a low-temperature low-humidity environment and may less cause fog and spots around line images.

In order to solve the above problems the prior art has had, the present inventors made extensive studies. As the result, they have discovered that the surface treatment of the grinding surfaces of the rotor and stator in the rotary mechanical grinding machine correlates with wear resistance, pulverization capacity and toner's developing performance, and have accomplished the present invention.

That is, the present invention is a toner production process having at least the steps of:

melt-kneading a mixture containing at least a binder resin and a colorant to obtain a kneaded product;

cooling the kneaded product to obtain a cooled product;

crushing the cooled product to obtain a crushed product;

pulverizing a powder material comprising the crushed product, by means of a grinding means to obtain a pulverized product; and classifying the pulverized product by a classifying means; wherein;

the grinding means comprises a mechanical grinding machine having at least a rotor which is a rotator attached to the center rotating shaft and a stator which is provided around the rotor, keeping a constant gap between the stator and the rotor surface; the grinding machine being so constructed that a circular space formed by keeping the gap stands airtight; and the surface of at least one of the rotor and the stator is coated by the plating of a chromium alloy containing at least chromium carbide.

DESCRIPTION OF THE PREFERRED EMBODIMENTS

First, an outline of a pulverization method making use of a rotary mechanical grinding machine used in the present invention is described with reference to FIGS. 1 to 3.

Figure 1:
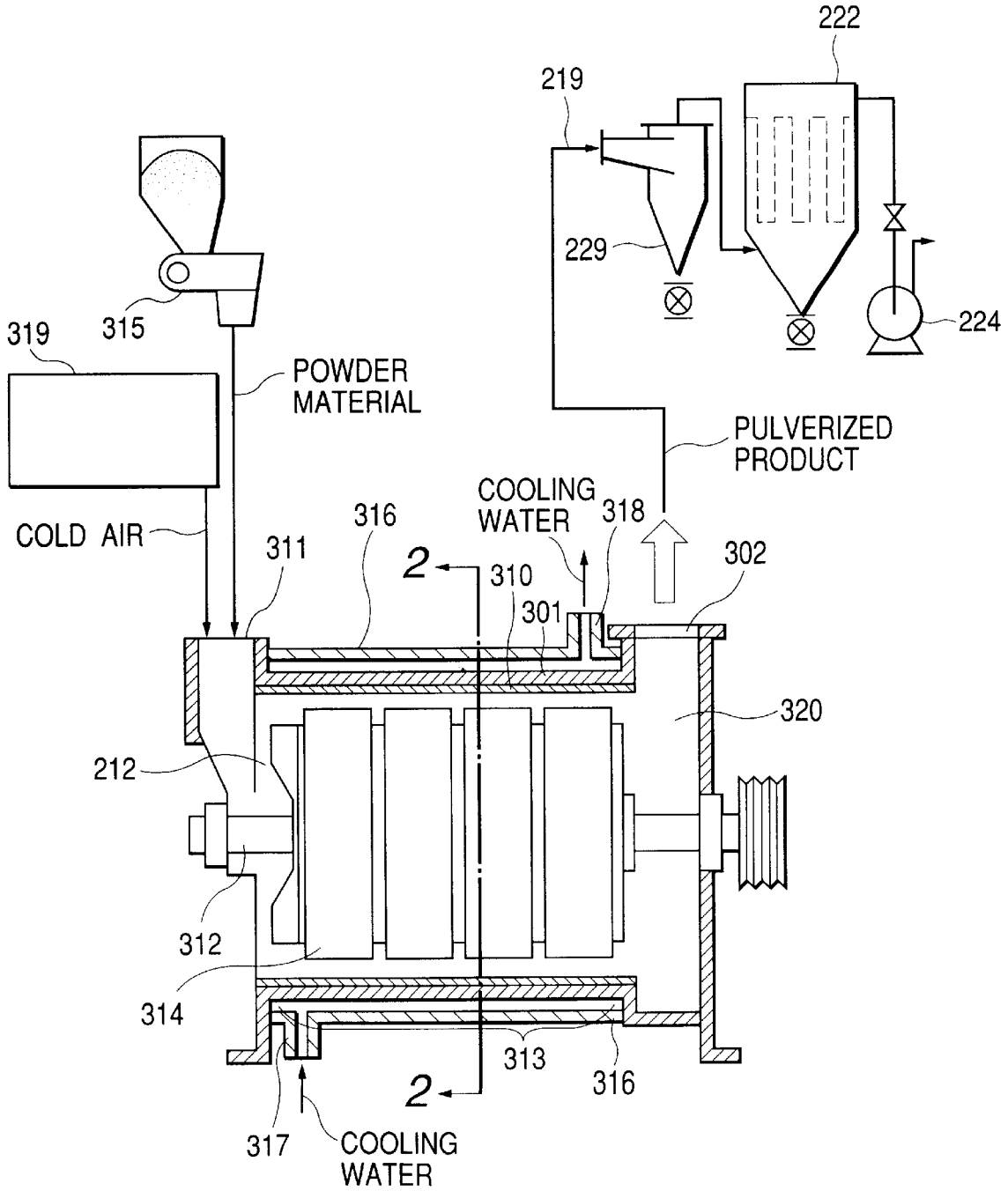
FIG. 1 is a schematic sectional view of an example of a mechanical grinding machine used in the step of pulverization in the toner production process of the present invention.

FIG. 1 illustrates an example of a pulverization system incorporated with a mechanical grinding machine used in the present invention. FIG. 2 is a schematic sectional view along the line 2—2 in FIG. 1. FIG. 3 is a perspective view of the rotor rotating at a high speed as shown in FIG. 1.

In FIG. 1, a commonly available mechanical grinding machine of a horizontal type is shown as a schematic sectional view. It may also be of a vertical type. This grinding machine is constituted of a casing 313, a jacket 316 which is provided inside the casing 313 and can pass cooling water therethrough, a rotor 314 which is provided in the casing 3, constituted of a rotator attached to a center rotating shaft 312, rotatable at a high speed and provided with a large number of grooves on its surface, a stator 310 which is disposed keeping a certain gap along the periphery of the rotor 314 and provided with a large number of grooves on its surface, a material feed opening 311 for introducing therethrough the material to be treated, and a material discharge opening 302 for discharging therethrough the powder having been treated.

In the mechanical grinding machine constituted as described above, the powder material is put in a stated quantity into the mechanical grinding machine through its material feed opening 311 from a constant-rate feeder 315 shown in FIG. 1, where the powder material is introduced into a pulverizing chamber, and is instantaneously pulverized in the pulverizing chamber by the action of i) the impact produced between the rotor 314 rotating at a high speed in the pulverizing chamber and provided with a large number of grooves on its surface and the stator 310 provided with a large number of grooves on its surface, ii) a large number of ultrahigh-speed whirls produced on the back of this impact and iii) the pressure vibration with high frequency that is caused by such whirls. Thereafter, the finely pulverized product formed is discharged passing through the material discharge opening 302. The air which is transporting the material particles is discharged to the outside of the unit system via the pulverizing chamber and through the material discharge opening 302, a pipe 219, a collecting cyclone 229 a bag filter 222 and a suction blower 224. In the present invention, the powder material is pulverized in this way and hence the desired pulverization can be performed with ease without forming the fine powder and coarse powder in a large quantity.

Figure 2:
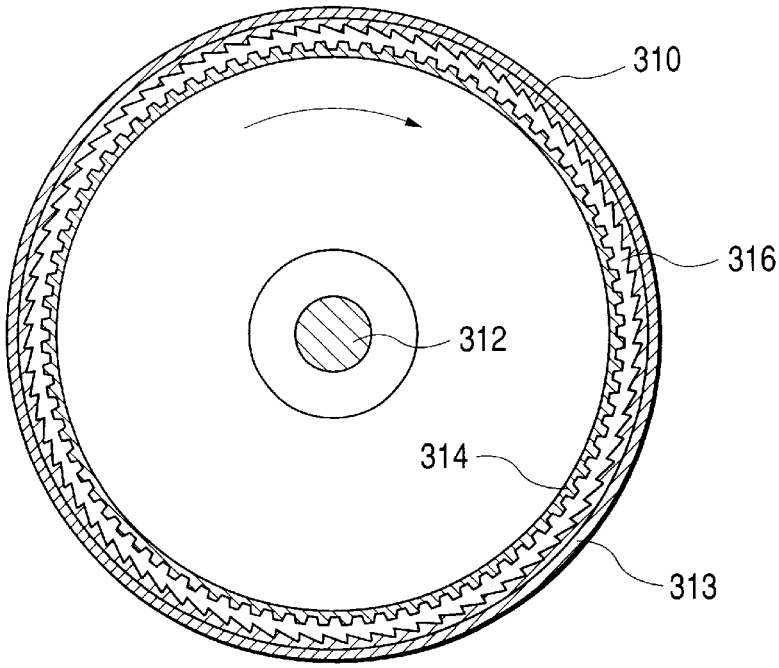
FIG. 2 is a schematic sectional view along the line 2—2 in FIG. 1.
Figure 3:
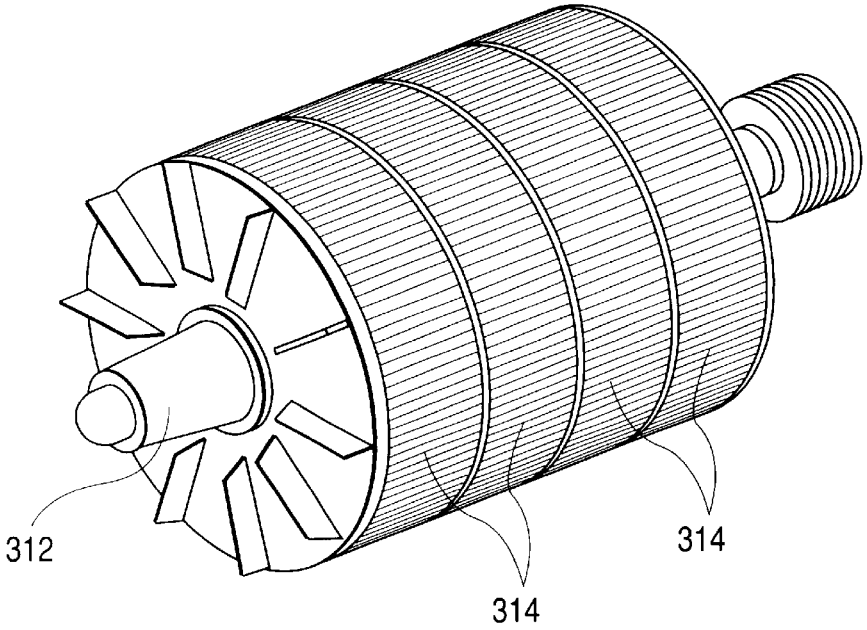
FIG. 3 is a perspective view of the rotor shown in FIG. 1.

Reference numerals shown in FIGS. 2 and 3 correspond to the reference numerals shown in FIG. 1.

Such a mechanical grinding machine may include, e.g., Inomizer (e.g., INM-100), a grinding machine manufactured by Hosokawa Micron Corporation; Kryptron (e.g., KTM-E3) and Zepros, grinding machines manufactured by Kawasaki Heavy Industries, Ltd.; Super Rotor (e.g., SR-75), manufactured by Nisshin Engineering Co.; and Turbo Mill (e.g., T-800), manufactured by Turbo Kogyo K.K. These machines may be used as they are, or may preferably be used after they are appropriately remodeled.

The present invention is a toner production process having at least the steps of melt-kneading a mixture containing at least a binder resin and a colorant to obtain a kneaded product, cooling the kneaded product to obtain a cooled product, crushing the cooled product to obtain a crushed product, pulverizing a powder material comprising the crushed product by means of a grinding means to obtain a pulverized product, and classifying the pulverized product by a classifying means; which is characterized in that a mechanical grinding machine having a rotor and/or a stator the surface(s) of which has or have been coated by the plating of a chromium alloy containing at least chromium carbide is used.

In the process for producing a toner by pulverization, a median pulverization step may be inserted between a crushing step of preparing particles of about 2 mm in particle diameter and a fine-grinding step of preparing particles of having the desired particle diameter. The pulverization process in the present invention may be any of this median pulverization step and the fine-grinding step. Also, the pulverization process in the present invention may have two or more stages connected in series or in parallel to perform pulverization. However, a process by which the effect of the present invention can be brought out to the maximum is a process in which the powder material is directly made into fine particles in one pass from the crushed product for toner.

As base members for the rotor and stator used in the mechanical grinding machine, carbon steel such as S45C, and Cr—Mo steel such as SCM material are often used. Coating these base member surfaces with a chromium alloy can provide a rotor and a stator which have a high surface hardness and have a high wear resistance and a long lifetime. Here, a chromium carbide having a strong force of intermolecular bond ($Cr_{23}C_6$), present in the chromium alloy, may be present from the surface layer to a certain greater depth, stated specifically, to a depth of at least 5 $\mu$m. This can improve the adhesion of the coating to the base member surface to make the phenomenon of peeling or cracking occur as less as possible.

In the present invention, the coating of the base member surface with the chromium alloy containing such a chromium carbide is made by "plating" so that the surface can uniformly and smoothly be finished to make its coefficient of friction small to improve wear resistance. Such plating may include Dichrone treatment (Chiyoda Daiichi Kagaku K.K.). After the plating, its surface may be subjected to polishing such as buffing or blast finishing such as shot blasting in order to regulate the surface roughness of the rotor or stator.

Elements present in the coating layer can be analyzed with an ion microanalyzer (e.g., IMA-S, manufactured by Hitachi Ltd.) or by secondary ion mass spectroscopy (SIMS) (using e.g., SIMS4500, manufactured by Seiko Instruments Co.). Elementary analysis in the depth direction can be made by etching the surface.

Figure 7:
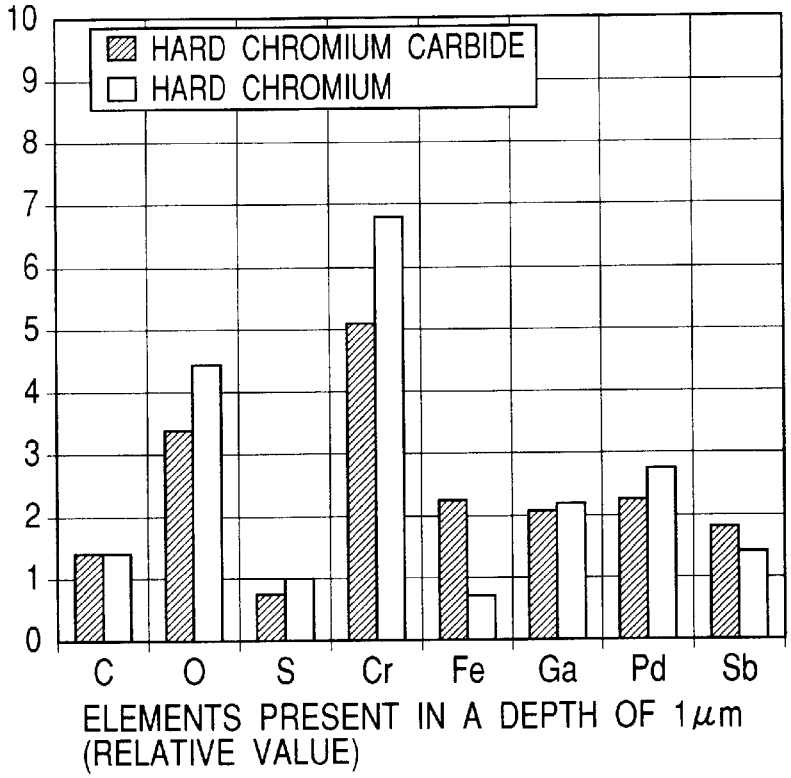
FIG. 7 is a graph showing an example of the results of analysis of elements present in a coating layer in its depth direction (depth: 1 $\mu$m).
Figure 8:
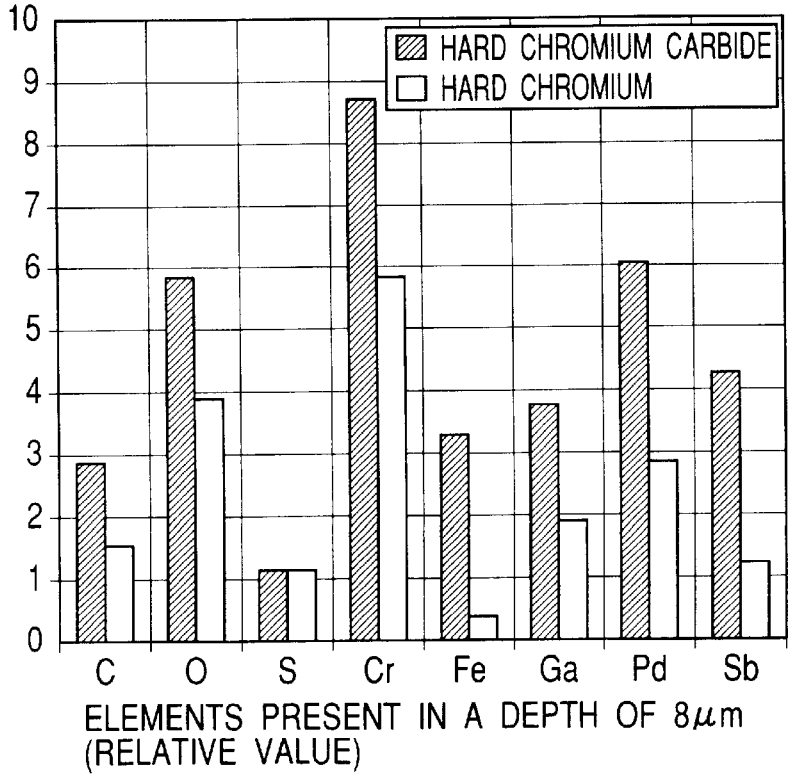
FIG. 8 is a graph showing an example of the results of analysis of elements present in a coating layer in its depth direction (depth: 8 $\mu$m).

Examples of the results of elementary analysis are shown in FIGS. 7 and 8. As can be seen therefrom, coatings formed by plating with hard chromium carbide contain the carbon component in a larger quantity even in a certain greater depth, than those usually formed by plating with hard chromium commonly available. More specifically, to examine the quantity of carbon present from the surface to a depth of 1 $\mu$m or a depth of 8 $\mu$m, there is no difference in the carbon component between the both in the depth of 1 $\mu$m (FIG. 7), whereas, in the depth of 8 $\mu$m the carbon component is present in a quantity of about twice the case of the hard chromium commonly available (FIG. 8), showing that a chromium carbide alloy layer stands formed.

The rotor and/or the stator may preferably have a surface hardness of from HV 900 to HV 1,300 (Vickers hardness 900 to 1,300), and may more preferably have a surface hardness of from HV 950 to HV 1,250, and particularly preferably from HV 970 to HV 1,230. The surface hardness in the present invention is measured under conditions that a load of 0.4903 N is kept for 30 seconds.

As long as the surface hardness is in the range of from HV 900 to HV 1,300, the grinding surfaces can be made to wear as less as possible, so that the rotor and the stator may be changed for new ones in a smaller number of times. If the surface hardness is lower than HV 900, the wear resistance may begin to lower and the pulverization capacity can not be improved. If the surface hardness is higher than HV 1,300, the surface may be so hard as to be brittle, tending to cause peeling or cracking, so that the rotor and the stator may begin to have to be frequently changed.

The pulverization using the mechanical grinding machine having the rotor and/or the stator which have been coated by the plating of a chromium alloy containing at least chromium carbide not only can make the grinding surface(s) of the rotor and/or stator extremely less wear to make the rotor and/or stator have a long lifetime, but also enables pulverization by rotating the rotor at a low peripheral speed because it has a hard surface, to pulverize the powder material in a desired particle diameter, and hence the load of pulverization can be made lower to bring about an improvement in pulverization capacity correspondingly.

Since also the powder material can be pulverized in a desired particle diameter at a low peripheral speed, any fine powder or ultrafine powder caused by over-pulverization may less occur, so that the pulverized product obtained by pulverization can have a very sharp particle size distribution, and, in the step of classification after the step of pulverization, a classified toner powder having a desired particle size distribution can be obtained in a very high yield.

In addition, since the powder material can be pulverized in a desired particle diameter at a low peripheral speed, the heat may less be generated at the time of pulverization, so that any melt adhesion and any unwanted formation of coarse particles in the grinding machine and any change in toner properties due to heat can be kept from occurring, and toner particles having been made to have a mechanically roundish shape can be produced without any uneven shape distribution. Hence, the toner particles produced by the process of the present invention afford a toner having a high developing performance, having less uneven chargeability and transfer performance and less causative of fog and spots around line images.

Such improvement in pulverization capacity and classification yield can more remarkably be brought about as the powder material to be pulverized is harder, and can be remarkable especially in the case of a magnetic toner containing a magnetic material in an amount of from 40 to 200 parts by weight based on 100 parts by weight of the binder resin.

However, in the course that such a hard powder material, e.g., the magnetic toner material is continued being pulverized, in particular, being finely pulverized in such a way that the powder material is made into fine particles in one pass from the crushed product for toner, the grinding surfaces may microscopically wear or come off. Although the wear is at a slighter degree than that of the rotor and stator having been subjected to conventional hard-wearing treatment, such a possibility can not perfectly be denied even with use of the mechanical grinding machine having the rotor and/or the stator the surface(s) of which has or have been coated by the plating of a chromium alloy containing at least chromium carbide.

To cope with such a situation, it is preferable that any plated component having worn or come off is removed and the exposed base member surface(s) of the rotor and/or stator is again coated by the plating described above, then the pulverization is carried out. Such a method enables continuous use of the rotor and/or stator without damaging their base members. Thus, material resources can effectively be utilized. Also, the circular space (pulverizing chamber) formed between the rotor and the stator can be kept at a constant volume, so that it is unnecessary to change conditions for pulverization and also the quality of the toner can always be stable.

The gap between the rotor and the stator, which determines the volume of the circular space (pulverizing chamber), may preferably be set in a minimum gap of from 0.5 to 10.0 mm, and more preferably from 1.0 to 5.0 mm. As long as the gap between the rotor and the stator is set in the gap of from 0.5 to 10.0 mm, more preferably from 1.0 to 5.0 mm, the powder material can be kept from being under-pulverized or over-pulverized, and the powder material can be pulverized in a good efficiency. If the gap between the rotor and the stator is larger than 10.0 mm, the powder material may undergo short pass without being pulverized. If on the other hand the gap between the rotor and the stator is smaller than 0.5 mm, the grinding machine itself may receive a great load and at the same time the powder material may be over-pulverized at the time of pulverization, to tend to cause the change in toner properties due to heat and the in-machine melt adhesion, resulting in a low productivity of the toner.

The coating layer of the chromium alloy containing the chromium carbide may preferably be in a thickness of from 20 to 300 $\mu$m, and more preferably from 30 to 200 $\mu$m. If the coating layer is in a thickness smaller than 20 $\mu$m, the effect of improving the wear resistance can not sufficiently be brought out. If it is in a thickness larger than 300 $\mu$m, the circular space (pulverizing chamber) may have so small a volume as to provide a great load at the time of pulverization to bring about a possibility of causing over-pulverization or in-machine melt adhesion.

The minimum gap between the rotor and the stator may preferably have a variation width of 0.5 mm or smaller, and more preferably 0.4 mm or smaller. As long as the variation width is set at 0.5 mm or smaller, the circular space (pulverizing chamber) can be of a small volume variation, and the powder material can stably be pulverized without changing any pulverization conditions.

As a preferred embodiment of the pulverization to obtain the toner, air of +30° C. or below may be sent into the mechanical grinding machine. The air may have a temperature of from +30° C. to −50° C., and particularly preferably from +20° C. to −40° C. Chamber temperature T1 at a whirl chamber 212 communicating with the powder material feed opening in the mechanical grinding machine shown in FIG. 1 may preferably be controlled to +20° C. or below, preferably from +20° C. to −40° C., and more preferably from +10° C. to −30° C., by a cold-air generating means 319. This is preferable in view of the productivity of toner.

Controlling the chamber temperature T1 at the whirl chamber 212 in the mechanical grinding machine to +20° C. or below, and more preferably from +10° C. to −30° C., enables the toner particles to be kept from changing in properties due to heat, enables the pulverizing material to be pulverized in good efficiency, keeps the toner particles from having uneven shape distribution, and makes fog less occur. If the chamber temperature T1 at the whirl chamber 212 in the mechanical grinding machine is higher than +20° C., the toner particles tend to change in properties due to heat or cause in-machine melt adhesion, bringing about problems on toner production and on developing and transfer performances in some cases.

A refrigerant is used in the cold-air generating means 319. The refrigerant used may preferably be a substitute flon (chlorofluorocarbon) taking account of the global environmental problems. The substitute flon may include R134A, R404A, R407C, R410A, R507A and R717. Of these, R404A is particularly preferred in view of energy saving and safety.

The finely pulverized product formed in the mechanical grinding machine is discharged to the outside of the grinding machine from a powder discharge opening 302, passing through a rear chamber 320 of the mechanical grinding machine. Here, the rear chamber 320 of the mechanical grinding machine may preferably have a chamber temperature T2 of from 30 to 60° C. in view of toner production and in view of developing and transfer performances.

Controlling the chamber temperature T2 at the rear chamber 320 in the mechanical grinding machine to from 30 to 60° C. enables the toner particles to be kept from changing in properties due to heat, enables the pulverizing material to be pulverized in good efficiency, keeps the toner particles from having uneven shape distribution, and makes fog less occur. If the chamber temperature T2 at the rear chamber 320 in the mechanical grinding machine is lower than 30° C., the powder material may have undergone short pass without being pulverized. If on the other hand it is higher than 60° C., the powder material may have been over-pulverized at the time of pulverization, to tend to cause a change in properties of toner particles due to heat or cause in-machine melt adhesion, bringing about problems on toner production and on developing and transfer performances in some cases.

When the pulverizing material is pulverized by means of the mechanical grinding machine, the chamber temperature T1 at the whirl chamber 212 and the chamber temperature T2 at the rear chamber 320 of the mechanical grinding machine may preferably be so controlled as to be in a temperature difference $\Delta T$ (T2−T1) of from 30 to 80° C., and may more preferably be from 35 to 75° C. in view of toner production and in view of developing and transfer performances. Controlling the $\Delta T$ between the temperature T1 and the temperature T2 in the mechanical grinding machine to from 30 to 80° C., and more preferably from 35 to 75° C., enables the toner particles to be kept from changing in properties due to heat, enables the pulverizing material to be pulverized in good efficiency, keeps the toner particles from having uneven shape distribution, and makes fog less occur. If the ΔT between the temperature T1 and the temperature T2 in the mechanical grinding machine is smaller than 30° C., the powder material may have undergone short pass without being pulverized. If on the other hand it is greater than 80° C., the powder material may have been over-pulverized at the time of pulverization, to tend to cause a change in properties of toner particles due to heat or cause in-machine melt adhesion, bringing about problems on toner production and on developing and transfer performances in some cases.

The powder material to be pulverized by means of the above mechanical grinding machine may contain a binder resin having a glass transition temperature Tg of from 45 to 75° C., and the chamber temperature T1 at the whirl chamber 212 in the mechanical grinding machine may be kept at +20° C. or below and also may be temperature-controlled to be lower by 40 to 80° C. than the glass transition temperature Tg of the binder resin (i.e., Tg−T1=40 to 80° C.). These are preferable in view of toner production and in view of developing and transfer performances. Keeping the the chamber temperature T1 at the whirl chamber 212 in the mechanical grinding machine at +20° C. or below and temperature-controlling it to be lower by 40 to 80° C. than the glass transition temperature Tg of the binder resin enables the binder resin from changing in properties, which is greatly causative of changes in properties of toner particles due to heat, enables the pulverizing material to be pulverized in good efficiency, keeps the toner particles from having uneven shape distribution, and makes fog less occur.

The chamber temperature T2 at the rear chamber 320 in the mechanical grinding machine may also preferably be temperature-controlled to be lower by 0 to 30° C. than the glass transition temperature Tg of the binder resin (i.e., Tg−T2=0 to 30° C.). This enables the toner particles from changing in properties due to heat, enables the pulverizing material to be pulverized in good efficiency, keeps the toner particles from having uneven shape distribution, and makes fog less occur.

In the present invention, the glass transition temperature Tg of the binder resin is measured with a differential thermal analyzer (a differential scanning calorimeter, DSC measuring instrument), DSC-7 (manufactured by Perkin Elmer Co.), or DSC2920 (manufactured by TA Instruments Japan Ltd.), under the following conditions.

Sample: 5 to 20 mg, preferably 10 mg.

Temperature Curve:

Heating I (20° C.→180° C.; heating rate: 10° C./min)

Cooling I (180° C.→10° C.; cooling rate: 10° C./min)

Heating II (10° C.→180° C.; heating rate: 10° C./min)

The Tg measured under the heating II is used as a measured value.

Measuring Method

The sample is put in a pan made of aluminum and an empty pan made of aluminum is used as a reference. The point at which the line at a middle point of the base line before and after appearance of an endothermic peak and the differential thermal curve intersect is regarded as the glass transition temperature Tg.

In order to temperature-control the chamber temperature T2 at the rear chamber in the mechanical grinding machine, it is preferable that the main body of the mechanical grinding machine is so constructed as to have the jacket 316 structure as an in-machine cooling means and that cooling water (preferably an anti-freeze such as ethylene glycol) is passed therethrough. According to this method, the chamber temperature T2 at the rear chamber in the mechanical grinding machine can be controlled also by the temperature and quantity of the water being passed.

Incidentally, the cooling water (preferably an anti-freeze such as ethylene glycol) is fed into the jacket from a cooling water feed opening 317 and is discharged through a cooling water discharge opening 318.

As described above, into the mechanical grinding machine having the rotor and/or the stator the surface(s) of which has or have been coated by the plating of a chromium alloy containing at least chromium carbide, present as a composite alloy ($Cr+Cr_{23}C_6$) even in a depth of at least 5 μm, the powder material is fed together with cold air, and is pulverized with temperature-controlling the chamber temperature at the rear chamber, whereby a toner free of any change in properties due to heat and having a high quality can be obtained in a high yield, at a high pulverization capacity that has not been attained by any conventional machines.

In the toner particles having been classified, produced by the toner production process of the present invention, toner particles having particle diameters of 2.0 μm or larger as circle-corresponding diameter may preferably have an average circularity SF-1 ranging from 0.73 to 0.90, and preferably from 0.74 to 0.80, an average surface unevenness 1·SF-2 ranging from 1.07 to 1.20, and an average surface unevenness 2·SF-5 of from 1.03 to 1.08.

In the toner produced by the toner production process of the present invention, toner having particle diameters of 2.0 μm or larger as circle-corresponding diameter may preferably have an average circularity SF-1 ranging from 0.71 to 0.90, and preferably from 0.72 to 0.80, an average surface unevenness 1·SF-2 ranging from 1.07 to 1.22, and an average surface unevenness 2·SF-5 of from 1.03 to 1.10.

Thus, according to the toner production process of the present invention, the process is suited for the production of toner particles having a sharp particle size distribution, and the toner particles afford a toner having a high developing performance, having less uneven chargeability and transfer performance and less causative of fog and spots around line images. Also, toner particles which can provide the toner with the circularity and surface unevenness within specific regions can be obtained, and the toner can be kept from having uneven shape distribution and hence can be a toner less causative of fog and spots around line images.

If the toner has an average circularity SF-1 of less than 0.71, the toner tends to have a low transfer performance, so that transfer residual toner may remain in a large quantity. Especially in cleanerless systems having been put into use in recent years, the transfer residual toner remaining in a large quantity may cause the inhibition of charging to cause serious faulty images.

If on the other hand the toner has an average circularity SF-1 of more than 0.90, the cleaning performance of toner may lower to tend to cause faulty images due to faulty cleaning.

Similarly, if the toner has an average surface unevenness 1·SF-2 of less than 1.07 or an average surface unevenness 2·SF-5 of less than 1.03, the prevention of blade slip-away of toner at the time of cleaning that is attributable to the surface unevenness may no longer operate to cause faulty cleaning.

If on the other hand the toner has an average surface unevenness 1·SF-2 of more than 1.22 or an average surface unevenness 2·SF-5 of more than 1.10, toner particle surfaces have so many projections and depressions that charging sites on the toner particle surfaces may stand localized, and the toner tends to be non-uniformly triboelectrically charged to cause fog and density decrease. Especially when the value of the average surface unevenness 2·SF-5 is great, it shows that the toner particle surfaces have many depressions, and the toner not only may have a difficulty in chargeability as stated above, but also tends to be affected by the moisture absorption due to outside environment.

In the present invention, the average circularity SF-1 indicates an average value of values obtained by calculation according to the following expression:

$$\text{Circularity}=(4\times A)/\{(ML)^2\times\pi\}$$

where ML represents the maximum length of a particle projected image, and A represents the projected area of a particle image.

In the present invention, the average surface unevenness 1·SF-2 indicates an average value of values obtained by calculation according to the following expression:

$$\text{Surface unevenness } 1=L^2/4\times\pi\times A)$$

where L represents the peripheral length of a particle projected image, and A represents the projected area of a particle image.

In the present invention, the average surface unevenness 2·SF-5 indicates an average value of values obtained by calculation according to the following expression:

$$\text{Surface unevenness } 2=L/C$$

where L represents the peripheral length of a particle projected image, and C represents the enveloping peripheral length of a particle projected image.

In the present invention, as a specific method for determining the above average circularity SF-1, average surface unevenness 1·SF-2 and average surface unevenness 2·SF-5, toner particle projected images magnified with an optical system are entered in an image analyzer, and their circle-corresponding diameter, peripheral length, maximum length, enveloping peripheral length and area are determined. Then, the values of circularity, surface unevenness 1 and surface unevenness 2 are calculated, and the values of these are averaged to determine their average values.

Here, as to the circle-corresponding diameter, the diameter of a circle having the same area is calculated as circle-corresponding diameter, from the area of a two-dimensional image of the toner particle or toner.

In the present invention, the measuring range is limited to the particles having circle-corresponding diameters of 2.0 μm or larger, which afford a reliability as the average values and also have a great influence on toner performances. Also, in order to ensure the reliability of these values, the measurement is made on 3,000 or more particles, and preferably 5,000 or more particles as the number of measuring particles.

As a specific measuring instrument which can efficiently analyze the circularity and surface unevenness of the toner particles and toner in such a large number of particles, a multi-image analyzer (manufactured by Beckman-Coulter Co.) is available.

The multi-image analyzer is an electrical-resistance method type particle size distribution measuring instrument with which the function to photograph particle images using a CCD (charge-coupled device) camera and the function to image-analyze the particle images photographed are combined. Stated in detail, measuring particles dispersed uniformly in an electrolytic solution are passed through an aperture of Multisizer, the electrical-resistance method type particle size distribution measuring instrument, and are detected by changes in electrical resistance when the particles are passed there, where particle images are photographed with the CCD camera, emitting light from a strobe in synchronization therewith. The particle images thus photographed are entered in a personal computer, and are binary-coded, followed by image analysis.

The particle size distribution can be measured by various methods. In the present invention, it is measured with a Coulter counter Multisizer.

A Coulter counter Multisizer Model II or IIE (manufactured by Coulter Electronics, Inc.) is used as a measuring instrument. An interface (manufactured by Nikkaki K.K.) that outputs number distribution and volume distribution and a commonly available personal computer are connected. As an electrolytic solution, an aqueous solution of about 1% NaCl is prepared using special-grade or first-grade sodium chloride. Measurement is made by adding as a dispersant from 0.1 to 5 ml of a surface-active agent (preferably alkylbenzenesulfonate) to from 100 to 150 ml of the above aqueous electrolytic solution, and further adding from 2 to 20 mg of a sample to be measured. The electrolytic solution in which the sample has been suspended is subjected to dispersion for about 1 minute to about 3 minutes in an ultrasonic dispersion machine. Measurement is made with the above Coulter counter Multisizer Model II, using an aperture of 100 μm. The volume and number of the toner are measured and the volume distribution and number distribution are calculated. Then the weight-based, weight average particle diameter (D4: the middle value of each channel is used as the representative value for each channel) of the toner determined from the volume distribution of toner particles are determined.

As channels, 13 channels are used, which are of 2.00 to 2.52 μm, 2.52 to 3.17 μm, 3.17 to 4.00 μm, 4.00 to 5.04 μm, 5.04 to 6.35 μm, 6.35 to 8.00 μm, 8.00 to 10.08 μm, 10.08 to 12.70 μm, 12.70 to 16.00 μm, 16.00 to 20.20 μm, 20.20 to 25.40 μm, 25.40 to 32.00 μm, and 32.00 to 40.30 μm.

In the toner particles having been classified, produced by the toner production process of the present invention, the relationship between specific surface area Sb per unit volume ($m^2/cm^3$) as measured by the BET method (BET specific surface area) and specific surface area St per unit volume ($m^2/cm^3$) as calculated from weight-average particle diameter when toner particles are assumed to be true spheres (theoretical specific surface area) may preferably fulfill the following condition:

$$Sb/St<2.5.$$

It may preferably be in the range of $1.5\leqq Sb/St<2.5$.

If the Sb/St is equal to or greater than 2.5, it follows that the toner particles have excessively large surface area, and moisture may adsorb on particle surfaces in an environment of high temperature and high humidity to affect developing performance, transfer performance and chargeabiliry adversely.

The BET specific surface area is determined by the BET multi-point method, using a full-automatic gas adsorption measuring device AUTOSORB-1, manufactured by Yuasa Ionics Co., Ltd. or automatic specific surface area measuring device GEMINI2375, manufactured by Shimadzu Corporation, and using nitrogen as adsorbing gas. As a pretreatment, the sample is deaerated at 50° C. for 1 hour. The specific surface area per unit weight thus determined is calculated from the true specific gravity of the toner to determine the specific surface area Sb per unit volume. The true specific gravity of the toner may be measured by a method in which the toner is compression molded and the true specific gravity is determined from the volume and weight of the molded product, or may be measured with a dry automatic density meter ACUPIC 1330, manufactured by Shimadzu Corporation.

The specific surface area St per unit volume as calculated from weight-average particle diameter when toner particles are assumed to be true spheres can be calculated from St=6/D4 (D4: weight-average particle diameter).

The toner obtained by the toner production process of the present invention may also preferably have a Carr's floodability index in a value of more than 80, and may more preferably have a Carr's fluidity index in a value of more than 60.

Methods of evaluating the fluidity of toners as described in the present invention are available in a large number. The fluidity of individual toners may be evaluated by any method suited for the toners, but it is true that there is also a possibility of lacking in generality. Accordingly, the Carr's fluidity index and Carr's floodability index are available as indices by which the fluidity of powder can synthetically been evaluated by measuring some phenomena and characteristics relating to fluidity.

The fluidity index can literally be a standard for evaluating the difficulty of flow-out ascribable to the gravity of powder, and the floodability index is a standard for determining how the phenomenon of flushing tends to occur. The flushing is a phenomenon in which the powder having been kept stationary to have a low fluidity comes into a fluidized state like a liquid when vibrated to begin being fluidized.

It means that, the higher the value of this floodability index is, the higher fluidity and floodability the toner has as a powder.

The fluidity index and the floodability index are measured in the following way (for details, see Japanese Patent Publication No. 51-14278).

Using Powder Tester P-100 (Hosokawa Micron Corporation), parameters of angle of repose, angle of fall (angle of rupture), difference angle, degree of compression (compressibility), degree of agglomeration, spatula angle and dispersibility are measured. The values obtained on these are fitted to the Carr's fluidity index table and Carr's floodability index table, and are converted into the corresponding indices of 25 or less each. The total of indices determined from the respective parameters are calculated as the fluidity index and floodability index. Measuring methods for the respective parameters are shown below.

(1) Angle of Repose 150 g of the toner is accumulated on a round table of 8 cm in diameter through a screen with a mesh of 710 $\mu$m. Here, the toner is accumulated to such an extent that it overflows from the edge of the table. The angle formed between the ridge of the toner thus accumulated on the table and the plane of the round table is measured by the aid of laser light to find the angle of repose.

(2) Degree of Compression

The degree of compression can be determined from loose-packing bulk density (loose apparent specific gravity A) and tapping bulk density (hard apparent specific gravity P).

$$\text{Degree of compression } (\%)=100(P-A)/P$$

Measurement of Loose Apparent Specific Gravity 150 g of the toner is gently flowed into a cup of 5 cm in diameter, 5.2 cm in height and 100 cc in volume. After the the toner has been heaped up in the cup for measurement, the toner surface is leveled at the cup edge. Then the loose apparent specific gravity is calculated from the quantity of the toner with which the cup is filled.

Measurement of Hard Apparent Specific Gravity

To the measuring cup used to measure the loose apparent specific gravity, an accessory cap is additionally fitted. The cup is filled with the toner, and this cup is tapped 180 times. At the time the tapping has been completed, the cap is removed, and the excess toner standing heaped up in the cap is leveled at the cup edge. Then the hard apparent specific gravity is calculated from the quantity of the toner with which the cup is filled.

The both apparent specific gravity values are inserted to the expression of degree of compression to determine the degree of compression.

(3) Spatula Angle

A spatula of 3 cm×8 cm is placed in a tray of 10 cm×15 cm in such a way that the former is in contact with the latter's bottom. The toner is accumulated on the spatula. Here, the toner is so accumulated as to heap on the spatula. Thereafter, only the tray is gently descended, and the angle of inclination of the side face of the toner having remained on the spatula is measured by the aid of laser light.

Thereafter, shock is once applied to the spatula with a shocker attached thereto, and then the spatula angle is again measured. The average of this measured value and the measured value before the application of the shock is calculated as the spatula angle.

(4) Degree of Agglomeration

On a vibrating stand, sieves are set in the order of 250 $\mu$m, 150 $\mu$m and 75 $\mu$m meshes from the top. Setting vibration width at 1 mm and vibration time at 20 seconds, 5 g of the toner is gently put on the stand, which is then vibrated. After the vibration is stopped, the weight of the toner remaining on each sieve is measured.

$$(\text{Weight of toner remaining on the upper stage})/5(\text{g})\times 100 \quad a$$

$$(\text{Weight of toner remaining on the middle stage})/5(\text{g})\times 100\times 0.6 \quad b$$

$$(\text{Weight of toner remaining on the lower stage})/5(\text{g})\times 100\times 0.2 \quad c$$

The value of a+b+c is calculated as the degree of agglomeration (%).

The values obtained from these parameters are converted into an index of 25 or less. The total of these values, (1)+(2)+(3)+(4), is the Carr's fluidity index.

(5) Angle of Fall (Angle of Rupture)

After the angle of repose has been measured, shock is applied three times to a tray on which the measuring round table is kept placed. Thereafter, the angle of the toner ruptured and remaining on the table is measured by the aid of laser light, and the angle measured is regarded as the angle of fall.

(6) Difference Angle

The difference between the angle of repose and the angle of fall (angle of rupture) gives the difference angle.

(7) Dispersibility 10 g of the toner is dropped in a mass on a watch glass of 10 cm in diameter, from a height of about 60 cm. Then, the toner remaining on the watch glass is weighed, and the dispersibility is determined from the following expression.

$$\text{Dispersibility } (\%)=(10-(\text{quantity of toner remaining on tray}))\times 10$$

The total of the indices which can be converted from the values of (5), (6) and (7) and the indices to which the value of fluidity index having been determined in the above corresponds can be determined as the floodability index.

As long as the toner is one showing the floodability index in a value of more than 80, more preferably the fluidity index in a value of more than 60, a high fluidity can be ensured, and hence the toner can readily constantly be transported from the toner-holding section to the developing zone, so that stable developing performance can be ensured even in the case of high-speed processing or in the case of large-volume processing.

If the toner has a floodability index of 80 or less, a high fluidity can be achieved but, once the toner has been caught, it does not easily become fluid even if a force is applied. Hence, the toner can not easily be transported even in an attempt to transport the toner by means of an agitation member or the like. As the result, the toner tends to become non-uniform on the developing sleeve and also become charged non-uniformly, tending to cause uneven images.

If the toner has a floodability index of 80 or less and also the toner has a fluidity index of 60 or less, the toner itself tends to agglomerate and also can be fluid with difficulty. Hence, not only the above image difficulties are brought about, but also the toner tends to melt-adhere to members with which it comes into contact.

According to the toner production process of the present invention, the toner can readily be made to have uniform particle shape, and the process can suitably be used to improve the fluidity of toner. Also, even after the grinding machine has been used over a long period of time, the same form of pulverization as that at the initial stage can be kept, and hence stable powder characteristics (floodability and fluidity) of toner can be attained.

Toner constituent materials used in the toner production process of the present invention are described below.

As the binder resin used in the present invention, all resins conventionally used in toners may be used. As its examples, it may include the following.

The binder resin may include, e.g., vinyl resins, phenol resins, natural-resin-modified phenolic resins, natural-resin-modified maleic-acid resins, acrylic resins, methacrylic resins, polyvinyl acetate, silicone resins, polyester resins, polyurethanes, polyamide resins, furan resins, epoxy resins, xylene resins, polyvinyl butyral, terpene resins, cumarone indene resins, and petroleum resins. In particular, vinyl resins and polyester resins are preferred in view of charging performance and fixing performance.

The vinyl resins may include, e.g., styrene; styrene derivatives such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene; ethylene unsaturated monoolefins such as ethylene, propylene, butylene and isobutylene; unsaturated polyenes such as butadiene; vinyl halides such as vinyl chloride, vinylidene chloride, vinyl bromide and vinyl fluoride; vinyl esters such as vinyl acetate, vinyl propionate and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; acrylic acid or methacrylic acid derivatives such as acrylonitrile, methacrylonitrile and acrylamide; α,β-unsaturated esters and diesters of dibasic acids; acrylic acids such as acrylic acid, methacrylic acid, α-ethylacrylic acid, crotonic acid, cinnamic acid, vinyl acetic acid, isocrotonic acid and angelic acid, and α- or β-alkyl derivatives thereof; unsaturated dicarboxylic acids such as fumaric acid, maleic acid, citraconic acid, alkenylsuccinic acid, itaconic acid, mesaconic acid, dimethylmaleic acid and dimethylfumaric acid, and monoester derivatives or anhydrides thereof. Any of these vinyl monomers may be used alone or in combination of two or more monomers.

Of these, monomers may preferably be used in such a combination that may give a styrene copolymer and a styrene-acrylic copolymer.

Also optionally usable are polymers or copolymers cross-linked with a cross-linkable monomer as exemplified below.

It may include aromatic divinyl compounds as exemplified by divinylbenzene and divinylnaphthalene; diacrylate compounds linked with an alkyl chain, as exemplified by ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and the above compounds whose acrylate moiety has been replaced with methacrylate; diacrylate compounds linked with an alkyl chain containing an ether linkage, as exemplified by diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and the above compounds whose acrylate moiety has been replaced with methacrylate; diacrylate compounds linked with a chain containing an aromatic group and an ether linkage, as exemplified by polyoxyethylene(2)-2,2-bis(4-hydroxyphenyl)propane diacrylate, polyoxyethylene(4)-2,2-bis(4-hydroxyphenyl) propane diacrylate, and the above compounds whose acrylate moiety has been replaced with methacrylate; and polyester type diacrylate compounds as exemplified by MANDA (trade name; available from Nippon Kayaku Co., Ltd.).

As a polyfunctional cross-linkable monomer, it may include pentaerythritol triacrylate, trimethylolethane triacrylate, trimethylolpropane triacrylate, tetramethylolmethane tetraacrylate, oligoester acrylate, and the above compounds whose acrylate moiety has been replaced with methacrylate; triallylcyanurate, and triallyltrimellitate.

Any of these cross-linkable monomers may preferably be used in an amount of from 0.01 to 10 parts by weight, and preferably from 0.03 to 5 parts by weight, based on 100 parts by weight of other monomer components.

Of these cross-linkable monomers, monomers preferably usable in resins for toners in view of fixing performance and anti-offset properties are aromatic divinyl compounds (in particular, divinylbenzene) and diacrylate compounds linked with a chain containing an aromatic group and an ether linkage.

In the present invention, a homopolymer or copolymer of vinyl monomer(s), or polyester, polyurethane, epoxy resin, polyvinyl butyral, rosin, modified rosin, terpene resin, phenolic resin, an aliphatic or alicyclic hydrocarbon resin or an aromatic petroleum resin may optionally be mixed with the above binder resin.

In the case when a mixture of two or more types of resins are used as the binder resin, as a more preferable form, those having different molecular weights may preferably be mixed in a suitable proportion.

The binder resin may preferably have a glass transition temperature of from 45 to 80° C., and more preferably from 55 to 70° C., a number-average molecular weight (Mn) of from 2,500 to 50,000 and a weight-average molecular weight (Mw) of from 10,000 to 1,000,000.

As processes for synthesizing binder resins comprised of vinyl polymers or vinyl copolymers, any of polymerization processes such as bulk polymerization, solution polymerization, suspension polymerization and emulsion polymerization may be used. Where carboxylic acid monomers or acid anhydride monomers are used, it is preferable in view of properties of monomers to use bulk polymerization or solution polymerization.

In the bulk polymerization, low-molecular weight polymers can be obtained by carrying out the polymerization at a high temperature and accelerating the rate of termination reaction. There is, however, a problem of a difficulty in reaction control.

In the solution polymerization, low-molecular weight polymers can readily be obtained under mild conditions by utilizing a difference in chain transfer of radicals, ascribable to solvents, and controlling the amount of polymerization initiators and the reaction temperature. Thus, the solution polymerization is preferred when a low-molecular weight component is formed in the resin composition used in the present invention.

As solvents used in the solution polymerization, xylene, toluene, cumene, cellosolve acetate, isopropyl alcohol or benzene may be used. In the case when a styrene monomer is used, xylene, toluene or cumene is preferred. The solvent may appropriately be selected according to the polymers to be produced by polymerization. The reaction temperature may vary depending on the solvents to be used, initiators, and polymers to be produced by polymerization. The reaction may usually be carried out at 70° C. to 230° C. The solution polymerization may preferably be carried out using the monomers in an amount of from 30 parts by weight to 400 parts by weight based on 100 parts by weight of the solvent. Other polymer(s) may also preferably be mixed in the solution when polymerization is terminated, whereby several kinds of polymers can well be mixed.

As methods for obtaining high-molecular weight components or gel components, emulsion polymerization and suspension polymerization are preferred.

Of these, the emulsion polymerization is a method in which a monomer almost insoluble in water is dispersed in an aqueous phase in the form of small particles by the use of an emulsifying agent and then polymerized using a water-soluble polymerization initiator. In this method, the heat of reaction can readily be controlled and the phase where polymerization takes place (an oily phase comprised of polymers and monomers) and the aqueous phase are separated, so that the rate of termination reaction can be low and hence the rate of polymerization can be high, making it possible to obtain a product with a high degree of polymerization. In addition, because of a relatively simple polymerization process and also because of a polymerization product formed of fine particles, the product can readily be mixed with colorants, charge control agents and other additives in the manufacture of toners, and hence this method is more advantageous than other methods, as a method of producing binder resins for toners.

The emulsion polymerization, however, tends to give an impurity to the resulting polymer because of an emulsifying agent added, and also requires operations such as salting-out to take out the polymer. Hence, the suspension polymerization is a simpler method.

The suspension polymerization may be carried out using the monomer in an amount of not more than 100 parts by weight, and preferably from 10 to 90 parts by weight, based on 100 parts by weight of the aqueous medium. Usable dispersants may include polyvinyl alcohol, a polyvinyl alcohol partially saponified product, and calcium phosphate. Usually, any of these dispersants may be used in an mount of from 0.05 to 1 part by weight based on 100 parts by weight of the aqueous medium. The polymerization may suitably be carried out at a temperature of from 50 to 95° C., which should appropriately be selected according to polymerization initiators to be used and the intended polymer. Any types of polymerization initiators may be used so long as they are insoluble or sparingly insoluble in water.

The polymerization initiator used may include t-butyl peroxy-2-ethylhexanoate, cumine perpivalate, t-butyl peroxylaurate, benzoyl peroxide, lauroyl peroxide, octanoyl peroxide, di-t-butyl peroxide, t-butylcumyl peroxide, dicumyl peroxide, 2,2'-azobis(2-isobutyronitrile), 2,2'-azobis(2-methylbutyronitrile), 2,2'-azobis(2,4-dimethylvaleronitrile), 2,2'-azobis(4-methoxy-2,4-dimethylvaleronitrile), 1,1-bis(t-butylperoxy)-3,3,5-trimethylcyclohexane, 1,1-bis(t-butylperoxy)cyclohexane, 1,4-bis(t-butylperoxycarbonyl)cyclohexane, 2,2-bis(t-butylperoxy)octane, n-butyl-4,4-bis(t-butylperoxy) valylate, 2,2-bis(t-butylperoxy)butane, 1,3-bis(t-butylperoxy-isopropyl)benzene, 2,5-dimethyl-2,5-di(t-butylperoxy) hexane, 2,5-dimethyl-2,5-di(benzoylperoxy)hexane, di-t-butyl peroxyisophthalate, 2,2-bis(4,4-di-t-butylperoxycyclohexyl)propane, di-t-butyl peroxy-α-methylsuccinate, di-t-butyl peroxydimethylglutarate, di-t-butyl peroxyhexahydroterephthalate, di-t-butyl peroxyazelate, diethylene glycol-bis(t-butylperoxycarbonate), di-t-butyl peroxytrimethyladipate, tris(t-butylperoxy) triazine, and vinyl tris(t-butylperoxy) silane. Any of these may used alone or in combination.

The initiator may be used in an amount of not less than 0.05 part by weight, and preferably from 0.1 part by weight to 15 parts by weight, based on 100 parts by weight of the monomers.

As the binder resin, a polyester resin shown below is also preferred.

The polyester resin has alcohol components in an amount of from 45 to 55 mol %, and acid components from 55 to 45 mol %, of the whole components.

As a dihydric alcohol component, it may include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol derivative represented by the following Formula (A);

(A)

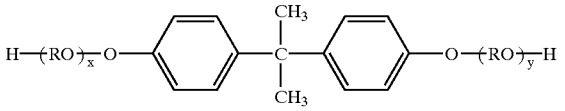

wherein R represents an ethylene group or a propylene group, x and y are each an integer of 1 or more, and an average value of x+y is 2 to 10;

and a diol represented by the following Formula (B).

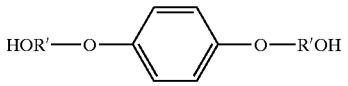

(B)

wherein R' represents —$CH_2CH_2$—,

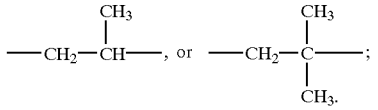

As a dibasic acid component, it may include dicarboxylic acids and derivatives thereof as exemplified by benzene dicarboxylic acids such as phthalic acid, terephthalic acid and isophthalic acid, and anhydrides such as phthalic anhydride or lower alkyl esters thereof; alkyldicarboxylic acids such as succinic acid, adipic acid, sebacic acid and azelaic acid, and anhydrides or lower alkyl esters thereof; alkenylsuccinic acids or alkylsuccinic acids such as n-dodecenylsuccinic acid and n-dodecylsuccinic acid, and anhydrides or lower alkyl esters thereof; and unsaturated dicarboxylic acids such as fumaric acid, maleic acid, citraconic acid and itaconic acid, and anhydrides or lower alkyl esters thereof.

A trihydric or higher alcohol component and a tribasic or higher acid component serving also as cross-linking components may also be used in combination.

The trihydric or higher, polyhydric alcohol component may include, e.g., sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxybenzene.

The tribasic or higher, polycarboxylic acid component may include polycarboxylic acids and derivatives thereof, e.g., trimellitic acid, pyromellitic acid, 1,2,4-benzenetricarboxylic acid, 1,2,5-benzenetricarboxylic acid, 2,5,7-naphthalenetri-carboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra (methylenecarboxyl) methane, 1,2,7,8-octanetetracarboxylic acid, Empol trimer acid, anhydrides of these, and lower alkyl esters of these; and tetracarboxylic acids represented by the following Formula (C):

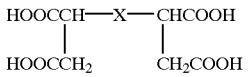

(C)

wherein X represents an alkylene group or alkenylene group having 5 to 30 carbon atoms having at least one side chain having 3 or more carbon atoms; anhydrides thereof, and lower alkyl esters thereof.

As a particularly preferred alcohol component of the polyester resin, it may include the bisphenol represented by the following Formula (A). As a particularly preferred acid component thereof, it may include dicarboxylic acids such as phthalic acid, terephthalic acid, isophthalic acid, or anhydrides of these, succinic acid, n-dodecenylsuccinic acid, or anhydrides of these, fumaric acid, maleic acid and maleic anhydride; and tricarboxylic acids such as trimellitic acid or an anhydride thereof.

The toner in which the polyester resin obtained from any of these acid components and alcohol components is used as the binder resin has good fixing performance and has superior anti-offset properties.

The polyester resin may preferably have an acid value of 90 mg·KOH/g or below, and more preferably 50 mg·KOH/g or below, and may preferably have an OH value of 50 mg·KOH/g or below, and more preferably 30 mg·KOH/g or below. This is because any too large number of terminal groups of the molecular chain may make the toner have a great dependence of charging performance on environment.

The polyester resin may preferably have a glass transition temperature of from 50 to 75° C., and more preferably from 55 to 65° C., and further may preferably have a number-average molecular weight (Mn) of from 1,500 to 50,000, and more preferably from 2,000 to 20,000, and a weight-average molecular weight (Mw) of from 6,000 to 100,000, and more preferably from 10,000 to 90,000.

The toner particles used in the present invention contain a colorant together with the binder resin described above. As the colorant, usable are carbon black, titanium white, and besides all sorts of pigments and/or dyes.

As non-magnetic colorants usable in the toner produced by the process of the present invention, they may be any suitable pigments or dyes. For example, as the pigments, usable are carbon black, aniline black, acetylene black, Naphthol Yellow, Hanza Yellow, Rhodamine Lake, Alizarine Lake, red iron oxide, Phthalocyanine Blue and Indanethrene Blue. Any of these may be added in an amount of from 0.1 to 20 parts by weight, and preferably from 1 to 10 parts by weight, based on 100 parts by weight of the binder resin. The dyes are also usable, including anthraquinone dyes, xanthene dyes and methine dyes, any of which may be added in an amount of from 0.1 to 20 parts by weight, and preferably from 0.3 to 10 parts by weight, based on 100 parts by weight of the binder resin.

Where in the toner production process of the present invention a magnetic toner is produced using a magnetic material as a colorant, the magnetic material as exemplified below may be used. In this case, the magnetic material serves also as the colorant. The magnetic material to be incorporated in the magnetic toner may include iron oxides such as magnetite, maghematite and ferrite, and iron oxides including other metal oxides; metals such as Fe, Co and Ni, or alloys of any of these metals with any of metals such as Al, Co, Cu, Pb, Mg, Ni, Sn, Zn, Sb, Be, Bi, Cd, Ca, Mn, Se, Ti, W and V, and mixtures of any of these.

The magnetic material may specifically include triiron tetraoxide ($Fe_3O_4$), iron sesquioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co) and nickel powder (Ni). Any of the above magnetic materials may be used alone or in combination of two or more types. A particularly preferred magnetic material is fine powder of triiron tetraoxide or $\gamma$-iron sesquioxide.

As the particle shape of these magnetic materials, it may be octahedral, hexahedral, spherical, acicular or flaky. Octahedral, hexahedral or spherical ones are preferred as having less anisotropy. This is because those having an isotropic shape can achieve a good dispersibility also in the binder resin and a wax which are used in the present invention.

These magnetic materials may also preferably be those having an average particle diameter of from 0.05 to 2 $\mu$m, a BET specific surface area as measured by nitrogen gas absorption, of from 1 to 40 $m^2/g$, and more preferably from 2 to 30 $m^2/g$, and a coercive force of from 1.6 to 12.0 kA/m, a saturation magnetization of from 50 to 200 $Am^2/kg$ (preferably from 50 to 100 $Am^2/kg$) and residual magnetization of from 2 to 20 $Am^2/kg$, as magnetic properties under application of a magnetic field of 795.8 kA/m.

Any of these magnetic materials may preferably be used in an amount of from 40 to 200 parts by weight, and more preferably from 60 to 150 parts by weight, based on 100 parts by weight of the binder resin. If it is less than 40 parts by weight, the toner may have insufficient transport performance to provide an uneven developer layer on a developer-carrying member, tending to cause uneven images and also tending to cause a decrease in image density ascribable to excessively high charging of the developer. If on the other hand it is more than 200 parts by weight, the developer may not sufficiently be charged to tend to cause a decrease in image density.

In the toner produced by the process of the present invention, a charge control agent may optionally be used in order to more stabilize the charging performance of the toner. As methods of incorporating the charge control agent in the toner, a method of adding it internally to toner particles and a method of adding it externally thereto are available. The charge control agent may preferably be used in an amount of from 0.1 to 10 parts by weight, and more preferably from 0.5 to 5 parts by weight, based on 100 parts by weight of the binder resin.

The charge control agent may includes the following.

As negative charge control agents capable of controlling the toner to be negatively chargeable, for example, organic metal complex salts and chelate compounds are effective, including monoazo metal complexes, aromatic hydroxycarboxylic acid metal complexes and aromatic dicarboxylic acid type metal complexes. Metal complex type monoazo compounds include monoazo dye metal complexes disclosed in, e.g., Japanese Patent Publication Nos. 41-20153, 42-27596, 44-6397 and 45-26478. Especially in view of dispersibility and charging performance, the charge control agent may preferably be a metal complex type monoazo compound represented by the following Formula (D). In particular, it is preferable to use a metal complex type monoazo compound the central atom of which is iron.

(D)

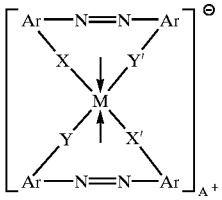

In the formula, M represents a central metal of coordination, and is Cr, Co, Ni, Mn, Fe, Ti or Al. Ar represents an aryl group such as a phenyl group or a naphthyl group, which may have a substituent. In such a case, the substituent includes a nitro group, a halogen atom, a carboxyl group, an anilido group, and an alkyl group or alkoxyl group having 1 to 18 carbon atoms. X, X', Y and Y' each represent —O—, —CO—, —NH— or —NR— (R is an alkyl group having 1 to 4 carbon atoms). $A^+$ represents a hydrogen ion, a sodium ion, a potassium ion, an ammonium or an aliphatic ammonium ion.

Besides, the charge control agent may also include aromatic hydroxycarboxylic acids, aromatic mono- or polycarboxylic acids, and metal salts, anhydrides or esters thereof, and phenol derivatives such as bisphenol.

A charge control agent capable of controlling the toner to be positively chargeable may include Nigrosine and modified products of Nigrosine, modified with a fatty acid metal salt; quaternary ammonium salts such as tributylbenzylammonium 1-hydroxy-4-naphthosulfonate and tetrabutylammonium teterafluoroborate; onium salts such as phosphonium salt, and lake pigments of these; triphenylmethane dyes and lake pigments of these (lake-forming agents may include tungstophosphoric acid, molybdophosphoric acid, tungstomolybdophosphoric acid, tannic acid, lauric acid, gallic acid, ferricyanides and ferrocyanides); metal salts of higher fatty acids; diorganotin oxides such as dibutyltin oxide, dioctyltin oxide and dicyclohexyltin oxide; and diorganotin borates such as dibutyltin borate, dioctyltin borate and dicyclohexyltin borate; guanidine compounds, and imidazole compounds. Any of these may be used alone or in combination of two or more types. Of these, triphenylmethane dyes compounds, and quaternary ammonium salts whose counter ions are not halogens may preferably be used.

Where the toner produced by the toner production process of the present invention is a color toner, it is particularly preferable to use charge control agents that are colorless, make toner charging speed higher and are capable of maintaining a constant charge quantity stably. As specific compounds of such charge control agents, they may include, as negative types, salicylic acid, naphthoic acid, dicarboxylic acid, metal compounds of derivatives of these, polymer type compounds having sulfonic acid or carboxylic acid in the side chain, boron compounds, urea compounds, silicon compounds, and carixarene. As positive types, they may include quaternary ammonium salts, polymer type compounds having such a quaternary ammonium salt in the side chain, guanidine compounds, and imidazole compounds.

Any of these charge control agents may preferably be used in an amount of from 0.1 to 10 parts by weight based on 100 parts by weight of the binder resin. In the present invention, however, the addition of the charge control agent is not essential. For example, toners used when images are formed by two-component development utilize the triboelectric charging with carriers. In the case of toners used in non-magnetic one-component blade-coating development, too, the triboelectric charging with a blade member or a sleeve member is actively utilized to charge the toners electrostatically. Accordingly, the charge control agent need not necessarily be contained in the toner particles.

In the toner production process of the present invention, at least one kind of wax may optionally be incorporated as a constituent material of the toner. The wax that can be used in such a case may include the following.

It may include, e.g., aliphatic hydrocarbon waxes such as low-molecular weight polyethylene, low-molecular weight polypropylene, microcrystalline wax and paraffin wax, oxides of aliphatic hydrocarbon waxes such as polyethylene oxide wax, and block copolymers of these; waxes composed chiefly of a fatty ester, such as carnauba wax, sazol wax and montanic acid ester wax; and those obtained by subjecting part or the whole of a fatty ester to deoxidation treatment, such as deoxidized carnauba wax.

It may also include saturated straight-chain fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol and melissyl alcohol; polyhydric alcohols such as sorbitol; fatty amides such as linolic acid amide, oleic acid amide and lauric acid amide; saturated fatty bisamides such as methylenebis(stearic acid amide), ethylenebis(capric acid amide), ethylenebis(lauric acid amide) and hexamethylenebis(stearic acid amide); unsaturated fatty amides such as ethylenebis(oleic acid amide), hexamethylenebis(oleic acid amide), N,N'-dioleyladipic acid amide and N,N'-dioleylsebacic acid amide; aromatic bisamides such as m-xylenebis(stearic acid amide) and N,N'-distearylisophthalic acid amide; aliphatic metal salts (what is commonly called metal soap) such as calcium stearate, calcium laurate, zinc stearate and magnesium stearate; grafted waxes obtained by graft-polymerizing vinyl monomers such as styrene or acrylic acid to aliphatic hydrocarbon waxes; partially esterified products of polyhydric alcohols with fatty acids, such as monoglyceride behenate; and methyl esterified products having a hydroxyl group, obtained by hydrogenation of vegetable fats and oils.

Waxes preferably usable are petroleum waxes such as paraffin wax, microcrystalline wax and petrolatum and derivatives thereof, montan wax and derivatives thereof, hydrocarbon waxes obtained by Fischer-Tropsch synthesis and derivatives thereof, polyolefin waxes typified by polyethylene wax and derivatives thereof, and naturally occurring waxes such as carnauba wax and candelilla wax and derivatives thereof. The derivatives include oxides, block copolymers with vinyl monomers, and graft modified products. The wax may also include alcohols such as higher aliphatic alcohols; fatty acids such as stearic acid and palmitic acid, and compounds thereof; and acid amides, esters, ketones, hardened caster oil and derivatives thereof, vegetable waxes, and animal waxes.

Of these, it is particularly preferable to use any of polyolefin waxes, hydrocarbon waxes obtained by Fischer-Tropsch synthesis, petroleum waxes or higher aliphatic alcohol waxes as a constituent material of the toner and to produce a toner containing any of these. In the toner production process of the present invention, it is more preferable to use, among the foregoing, any of the polyolefin waxes, hydrocarbon waxes obtained by Fischer-Tropsch synthesis, petroleum waxes or higher aliphatic alcohol waxes as a constituent material of the toner.

When the wax is used in the present invention, it may preferably be used in an amount of from 0.1 to 45 parts by weight based on 100 parts by weight of the binder resin.

A fluidity improver may be added to the toner produced by the process of the present invention. The fluidity improver is an agent which can improve the fluidity of the toner by its external addition to toner particles, as seen in comparison before and after its addition. For example, it may include fluorine resin powders such as fine vinylidene fluoride powder and fine polytetrafluoroethylene powder; fine silica powders such as wet-process silica and dry-process silica, fine titanium oxide powder, fine alumina powder, and treated silica powder obtained by subjecting these powders to surface treatment with a silane compound, a titanium coupling agent or a silicone oil. Any of these may be used alone or in combination.

A preferred fluidity improver includes fine powders formed by vapor phase oxidation of a silicon halide, i.e., what is called dry-process silica or fumed silica and what is called wet-process silica produced from water glass or the like. The dry-process silica is preferred, as having less silanol groups at the surface and inside and leaving no production residues such as $Na_2O$ and $SO_3^{2-}$. In the dry-process silica, it is also possible to use, in its production step, other halide such as aluminum chloride or titanium chloride together with the silicon halide to obtain a composite fine powder of silica with other metal oxide. The fine silica powder includes these, too.

As for its particle diameter, it is preferable to use fine silica powder having an average primary particle diameter within the range of from 0.001 to 2 $\mu$m, and particularly preferably within the range of from 0.002 to 0.2 $\mu$m.

Commercially available fine silica powders produced by the vapor phase oxidation of silicon halides include, e.g., those which are on the market under the following trade names.

AEROSIL 130, 200, 300, 380, TT600, MOX170, MOX80, COK84 (Aerosil Japan, Ltd.);

Ca—O—SiL M-5, MS-7, MS-75, HS-5, EH-5 (CABOT Co.);

Wacker HDK N20, V15, N20E, T30, T40 (WACKER-CHEMIE GMBH);

D-C Fine Silica (Dow-Corning Corp.); and

Fransol (Fransil Co.).

It is also preferable to use treated fine silica powder obtained by making hydrophobic the fine silica powder produced by vapor phase oxidation of a silicon halide. In the treated fine silica powder, a fine silica powder is particularly preferred which has been so treated that its hydrophobicity as measured by a methanol titration test shows a value within the range of from 30 to 80.

As methods for making hydrophobic, the fine silica powder may be made hydrophobic by chemical treatment with an organosilicon compound capable of reacting with or physically adsorbing the fine silica powder. A preferable method may include a method in which the dry process fine silica powder produced by vapor phase oxidation of a silicon halide is treated with a silane coupling agent and thereafter, or simultaneously with the treatment with the silane coupling agent, treated with an organosilicon compound such as silicone oil.

The silane coupling agent used in the hydrophobic treatment may include, e.g., hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, tirornanosilyl mercaptan, trimethylsilyl mercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and a dimethylpolysiloxane having 2 to 12 siloxane units per molecule and containing a hydroxyl group bonded to each Si in its units positioned at the terminals.

The organosilicon compound may include silicone oils. As preferred silicone oils, those having a viscosity at 25° C. of from 30 to 1,000 $mm^2/s$ may be used. For example, dimethylsilicone oil, methylphenylsilicone oil, α-methylstyrene-modified silicone oil, chlorophenylsilicone oil and fluorine-modified silicone oil are particularly preferred. Any of these may be used alone or in the form of a mixture of two or more types.

As methods for the treatment with silicone oil, for example, the fine silica powder having been treated with a silane coupling agent may directly be mixed with the silicone oil by means of a mixer such as a Henschel mixer, or the fine silica powder, serving as a base, may be sprayed with the silicone oil.

As the fluidity improver, those having a specific surface area of 30 $m^2/g$ or larger, and preferably 50 $m^2/g$ or larger, as measured by the BET method utilizing nitrogen absorption provides good results. The fluidity improver may be used in an amount of from 0.01 to 8 parts by weight, and preferably from 0.1 to 4 parts by weight, based on 100 parts by weight of the toner.

In the toner produced by the process of the present invention, additives other than the fine silica powder or fine titanium oxide powder may optionally be added. They are, for example, fine resin particles or inorganic fine particles that act as a charging auxiliary agent, a conductivity-providing agent, an anti-caking agent, a release agent at the time of heat roll fixing, a lubricant, or an abrasive.

Such additives may include, e.g., lubricants such as polyfluoroethylene, stearic acid and polyvinylidene fluoride (in particular, polyvinylidene fluoride is preferred); abrasives such as cerium oxide, silicon carbide and strontium titanate (in particular, strontium titanate is preferred); fluidity-providing agents such as titanium oxide and aluminum oxide (in particular, hydrophobic one is preferred); anti-caking agents; and conductivity-providing agents such as carbon black, zinc oxide, antimony oxide and tin oxide. Reverse-polarity white fine particles and black fine particles may also be used in a small quantity as a developability improver.

The fine resin particles, inorganic fine particles or hydrophobic inorganic fine particles mixed in the toner particles may be used in an amount of from 0.1 to 5 parts by weight, and preferably from 0.1 to 3 parts by weight, based on 100 parts by weight of the toner.

The toner produced by the process of the present invention may be blended with a carrier so as to be used as a two-component developer. As the carrier used in two-component development, conventionally known carriers may be used. Stated specifically, particles of metals such as iron, nickel, cobalt, manganese, chromium and rare earth elements, and alloys or oxides thereof, having been surface-oxidized or unoxidized and having an average particle diameter of from 20 to 300 $\mu$m, may be used.

It is preferable to use carriers comprising such carrier particles to or on the surfaces of which a resin such as styrene resin, acrylic resin, silicone resin, fluorine resin or polyester resin has been made to adhere or coated.

A procedure is described below by which a toner is produced by the toner production process of the present invention using the materials for forming toner particles and the external additives described above.

First, in the step of mixing materials, as internal additives at least the binder resin and the colorant are weighed in the stated quantities, and compounded and mixed by means of a mixing machine. The mixing machine includes, for example, a double-cone mixer, a V-type mixer, a drum-type mixer, Super mixer, Henschel mixer and Nauta mixer.

Next, the toner materials compounded and mixed as above are melt-kneaded to cause resins to melt and to make the colorant and so forth dispersed in the molten resin. In this step of melt-kneading, for example a batch-type kneader such as a pressure kneader or Banbury mixer or a continuous kneader may be used. In recent years, because of an advantage that the toner material can continuously be produced, a single- or twin-screw extruder is prevailing. For example, commonly used are a KTK-type twin-screw extruder manufactured by Kobe Seikosho K.K., a TEM-type twin-screw extruder manufactured by Toshiba Machine Co., Ltd., a twin-screw extruder manufactured by KCK K.K., a PCM-type twin-screw extruder manufactured by Ikegai Tekkosho K.K., and a co-kneader manufactured by Buss Co.

The colored resin composition obtained by melt-kneading the toner material is, after melt-kneading, further rolled with a twin roll or the like, and then cooled through the step of cooling the product by water cooling.

The cooled product of the colored resin composition, thus obtained, is then pulverized in the step of pulverization to have the desired particle diameter. In the pulverization step, first the cooled product is crushed by means of a crusher, a hammer mill, a feathermill or the like, and is further pulverized by means of the mechanical grinding machine described previously. A median pulverization step may be provided between these steps. As a median pulverization grinding machine used therefor, an ACM pulverizer or MVM vertical mill manufactured by Hosokawa Micron Corporation may be used. Also, the pulverization process according to the present invention may be modified for median pulverization.

In the pulverization step, the powder material is thus stepwise pulverized to have the stated toner particle size. After the pulverization, the pulverized-product toner particles are further classified using an inertial-classification type classifier Elbow Jet, a centrifugal-classification type classifier Microplex or an SD separator to obtain toner particles having an average particle diameter of from 3 to 15 $\mu$m. Of these, a multi-division gas current classifier is particularly preferred as the classifier.

Figure 4:
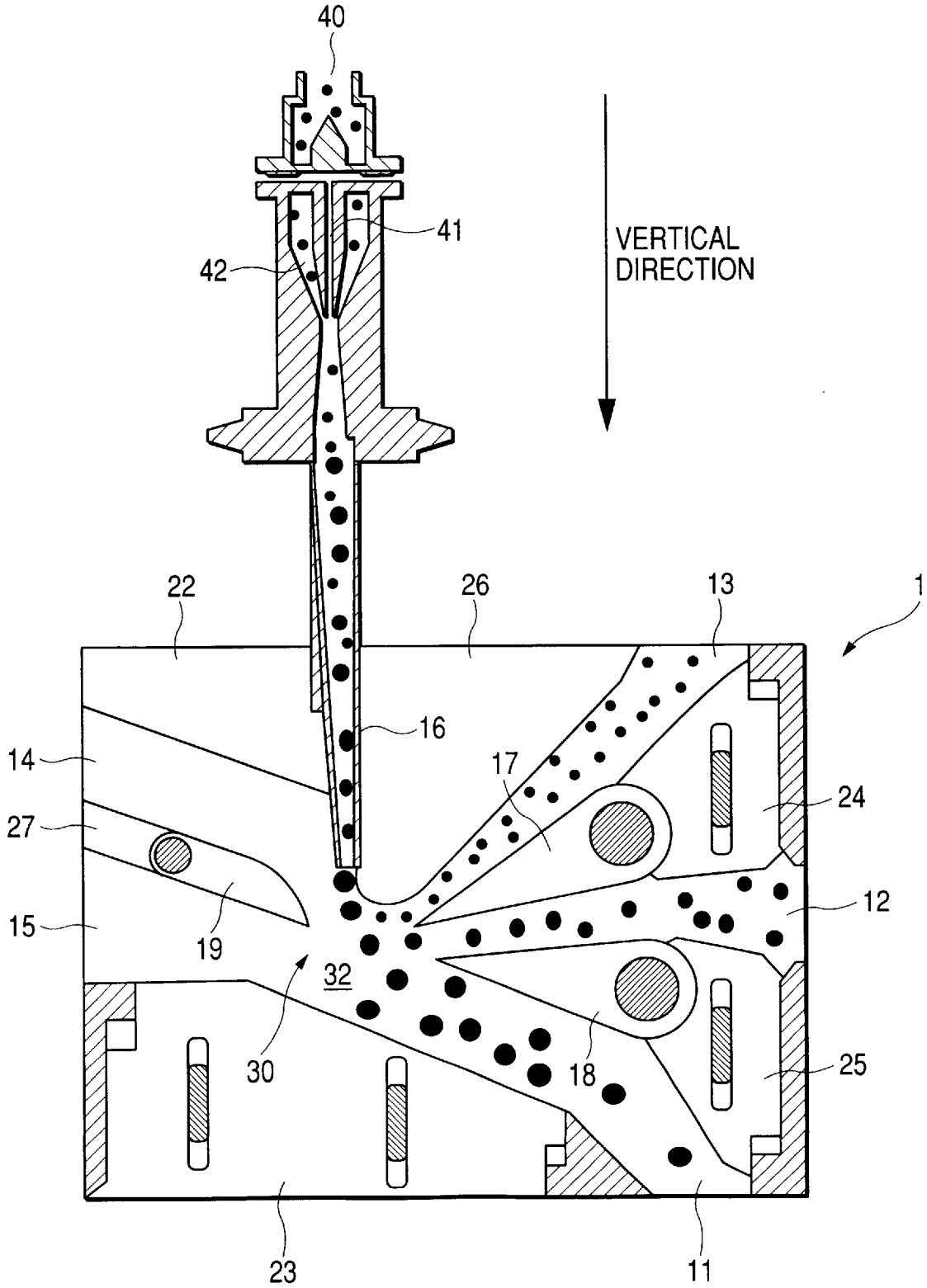
FIG. 4 is a schematic sectional view of a multi-division gas current classifier preferably used in the step of classification in the toner production process of the present invention.

As an example of a preferred multi-division gas current classifier, an apparatus having the form as shown in FIG. 4 (cross-sectional view) is shown as a specific example.

As shown in FIG. 4, a sidewall 22 and a G-block 23 form part of a classifying chamber, and classifying edge blocks 24 and 25 have classifying edges 17 and 18, respectively. The G-block 23 is right and left slidable for its setting position. Also, the classifying edges 17 and 18 stand swing-movable around shafts 17*a* and 18*a*, respectively, and thus the tip position of each classifying edge can be changed by the swinging of the classifying edge. The respective classifying edge blocks 24 and 25 are so set up that their locations can be slided right and left. As they are slided, the corresponding knife-edge type classifying edges 17 and 18 are also slided right and left. These classifying edges 17 and 18 divide a classification zone 30 of the classifying chamber 32 into three sections.

A material feed nozzle 16 having at its rearmost-end part a material feed opening 40 for introducing a material powder therethrough, having at its rear-end part a high-pressure air nozzle 41 and a material powder guide nozzle 42 and also having an orifice in the classifying chamber 32 is provided on the right side of the sidewall 22, and a Coanda block 26 is disposed along an extension of the lower tangential line of the material feed nozzle 16 so as to form a long elliptic arc. The classifying chamber 32 has a left-part block 27 provided with a knife edge-shaped air-intake edge 19 extending toward the classifying chamber 32, and further provided with air-intake pipes 14 and 15 on the left side of the classifying chamber 32, which open to the classifying chamber 32.

The locations of the classifying edges 17 and 18, G-block 23 and the air-intake edge 19 are adjusted according to the kind of the toner particles, the material powder to be classified, and also according to the desired particle size.

At the bottom, sidewall and top of the classifying chamber 32, discharge outlets 11, 12 and 13, respectively, which open to the classifying chamber are provided correspondingly to the respective divided zones. The discharge outlets 11, 12 and 13 are connected with communicating means such as pipes, and may respectively be provided with shutter means such as valve means.

The material feed nozzle 16 comprises a rectangular pipe section and a pyramidal pipe section, and the ratio of the inner diameter of the rectangular pipe section to the inner diameter of the narrowest part of the pyramidal pipe section may be set at from 20:1 to 1:1, and preferably from 10:1 to 2:1, to obtain a good feed velocity.

The classification in the multi-division classifying zone having the above construction is operated, for example, in the following way. The inside of the classifying chamber is evacuated through at least one of the discharge outlets 11, 12 and 13. The material powder is jetted, and dispersed, into the classifying chamber 32 through the material feed nozzle 16 at a flow velocity of preferably from 10 to 350 m/sec, utilizing the gas stream flowing under the evacuation through the path inside the material feed nozzle 16 opening into the classifying chamber 32, and utilizing the ejector effect of compressed air jetted from the high-pressure air nozzle 41.

The particles in the material powder fed into the classifying chamber 32 is moved to draw curves by the action attributable to the Coanda effect of the Coanda block 26 and the action of gases such as air concurrently flowed in, and are classified according to the particle size and inertia force of the individual particles in such a way that larger particles (coarse particles) are classified to the outside of gas streams, i.e., the first division on the outer side of the classifying edge 18, median particles are classified to the second division defined between the classifying edges 18 and 17, and smaller particles are classified to the third division at the inner side of the classifying edge 17. The larger particles (coarse powder) separated by classification, the median particles separated by classification and the smaller particles (fine powder) separated by classification are discharged from the discharge outlets 11, 12 and 13, respectively.

In the above classification of material powder, the classification points chiefly depend on the tip positions of the classifying edges 17 and 18 with respect to the lower end of the Coanda block 26 at which end the material powder is jetted out into the classifying chamber 32. The classification points are also influenced by the suction flow rate of classification gas streams or the velocity of the material powder jetted out of the material feed nozzle 16.

The multi-division gas current classifier described above is effective especially when toners used in methods of forming images by electrophotography or colored resin powders for such toners are classified.

In addition, in the multi-division gas current classifier having the form as shown in FIG. 4, the material feed nozzle 16, the material powder guide nozzle 42 and the high-pressure air nozzle 41 are provided at the upper part of the multi-division gas current classifier, and the classifying edge blocks having classifying edges are set positionally changeable so that the classification zone can be changed in shape. Hence, the classifier can dramatically be more improved in classification efficiency than any conventional gas current classifiers (air classifier).

The coarse powder formed upon classification in the classification step is returned to the pulverization step so as to be again pulverized. Also, the fine powder formed in the classification step may be returned to the step of compounding the toner materials so as to be reused.

To the toner particles thus obtained, inorganic fine particles having an average particle diameter of 50 nm or smaller are further added as an external additive. As a method of adding the external additive to the toner particles to make treatment, the toner particles having been classified and a known external additive may be mixed in stated quantities. As an apparatus for external addition treatment, it may include, e.g., Henschel mixer (manufactured by Mitsui & Smelting Co., Ltd.), Super mixer (manufactured by Kawata K.K.), Nauta mixer, Turbulizer, Cyclomix (manufactured by Hosokawa Micron Corporation), Spiral mixer (manufactured by Taiheiyo Kiko K.K.) and Lodige mixer (manufactured by Matsubo K.K.). To achieve the above state of external addition by using any of these apparatus, describing the case of the Henschel mixer, an agitating container may be packed with the toner material powder at an apparent volume packing of from 8 to 30%, and preferably from 10 to 25%, and, as construction of agitating blades at the time of treatment, a blade shape which can cause the powder accumulated at the bottom of the container to convect throughout the interior of the container and a blade shape which can apply appropriate shear force to the powder and make mechanical treatment while forcing back to the lower part of the container the powder having flied up may preferably be used in combination. Under the above conditions, the powder in the container can be in not a too high concentration, and hence the space necessary for the external addition treatment can be ensured. Thus, the agitating blades can impart high impact and agitation force to the toner particles, and hence the external additive can be present on toner particle surfaces in various states and the toner having the intended high floodability can be obtained. As an agitation mode used here, it is preferable to change the number of revolutions of the agitating blades by some stages so that the state of the external additive adhering to toner particles can be intermingled in variety. It it is also preferable to repeat treatment several times after the treatment has been made once, to select the state of agitation in which the force can be applied acceleratedly.

EXAMPLES

The present invention is described below in greater detail by giving Examples and Comparative Examples.

Powder Material Production Example 1

| | (by weight) |
|---|---|
| Styrene/n-butyl acrylate copolymer (Tg: 58° C.; Mw: 150,000) | 100 parts |
| Spherical magnetic iron oxide (average particle diameter: 0.20 $\mu$m; BET specific surface area: 8.0 $m^2/g$; coercive force: 3.7 kA/m; saturation magnetization: 82.3 $Am^2/kg$; residual magnetization: 4.0 $Am^2/kg$) | 100 parts |
| Iron azo compound (negative charge control agent) | 2 parts |
| Polypropylene wax (DSC endothermic peak temperature: 145° C.) | 3 parts |

The materials formulated as above were mixed using a mixer, and thereafter the mixture obtained was kneaded by means of a twin-screw kneader (PCM-30 Model, manufactured by Ikegai Corp.) set to a temperature of 130° C. The kneaded product obtained was cooled, and then crushed by means of a hammer mill to a size of 2 mm or smaller to obtain a powder material (crushed product) A as a powder material for toner production.

Powder Material Production Example 2

| | (by weight) |
|---|---|
| Polyester resin (Tg: 60° C.; Mw: 15,000; acid value: 25 mg · KOH/g; hydroxyl value: 28 mg · KOH/g) | 100 parts |
| Spherical magnetic iron oxide (average particle diameter: 0.20 μm; BET specific surface area: 8.0 $m^2/g$; coercive force: 3.7 kA/m; saturation magnetization: 82.3 $Am^2/kg$; residual magnetization: 4.0 $Am^2/kg$) | 90 parts |
| Iron azo compound (negative charge control agent) | 2 parts |
| Polypropylene wax (DSC endothermic peak temperature: 145° C.) | 3 parts |

The materials formulated as above were mixed using a mixer, and thereafter the mixture obtained was kneaded by means of a twin-screw kneader (PCM-30 Model, manufactured by Ikegai Corp.) set to a temperature of 130° C. The kneaded product obtained was cooled, and then crushed by means of a hammer mill to a size of 2 mm or smaller to obtain a powder material (crushed product) B as a powder material for toner production.

Example 1

The powder material A was finely pulverized by means of the mechanical grinding machine 301 shown in FIG. 1 (Turbo mill Model T250-RS, manufactured by Turbo Kogyo K.K.). The finely pulverized product obtained was classified by means of the multi-division gas current classifier shown in FIG. 4.

The mechanical grinding machine used in this Example had the rotor and the stator the surfaces of which were coated by the hard chromium carbide alloy plating whose results of elementary analysis were shown in FIGS. 7 and 8 (coating thickness: 150 μm; surface hardness: HV 1,050), and the minimum gap between the rotor and the stator was set to be 1.5 mm. Then, setting at −15° C. the temperature of the air introduced into the mechanical grinding machine and setting the rotor peripheral speed at 110 m/s and the pulverization feed rate at 40 kg/h, the powder material A was finely pulverized while cooling water was passed through the jacket. As the result, the finely pulverized product obtained had a weight-average particle diameter of 6.6 μm.

The powder material A was finely pulverized over a period of 2 hours under the above conditions. As the result, the temperature T1 in whirl chamber and temperature T2 in rear chamber in the grinding machine were −10° C. and 43° C., respectively, thus the ΔT between T1 and T2 was 53° C. Also, the Tg−T1 was 68° C. and the Tg−T2 was 15° C., enabling the fine pulverization stably. The finely pulverized product thus obtained, having a weight-average particle diameter of 6.6 μm, had a sharp particle size distribution, containing 33.2% by number of particles of 4.0 μm or smaller in particle diameter and 3.1% by volume of particles of 10.1 μm or larger in particle diameter.

After the pulverization carried out for 2 hours in the manner described above, the interior of the grinding machine was inspected. As the result, any melt adhesion of toner was not seen in the interior of the grinding machine.

Next, the finely pulverized product obtained was introduced into the multi-division gas current classifier having the construction as shown in FIG. 4, and strictly classified to obtain a classified product having a weight average particle diameter of 6.5 μm and containing 21.2% by number of particles of 4.0 μm or smaller in particle diameter and 1.1% by volume of particles of 10.1 μm or larger in particle diameter. Here, the ratio of the weight of the classified product to the weight of the finely pulverized product, i.e., classification yield, was 87% in weight ratio.

The toner particles having circle-corresponding diameters of 2.0 μm or larger had an average circularity SF-1 of 0.75, an average surface unevenness 1·SF-2 of 1.13 and an average surface unevenness 2·SF-5 of 1.04.

The BET specific surface area Sb per unit volume and theoretical specific surface area St per unit volume of the toner particles were 1.87 $m^2/cm^3$ and 0.92 $m^2/cm^3$, respectively. Therefore, Sb/St was 2.03.

The conditions and results relating to the above pulverization and classification are shown in Table 1.

Figure 9:
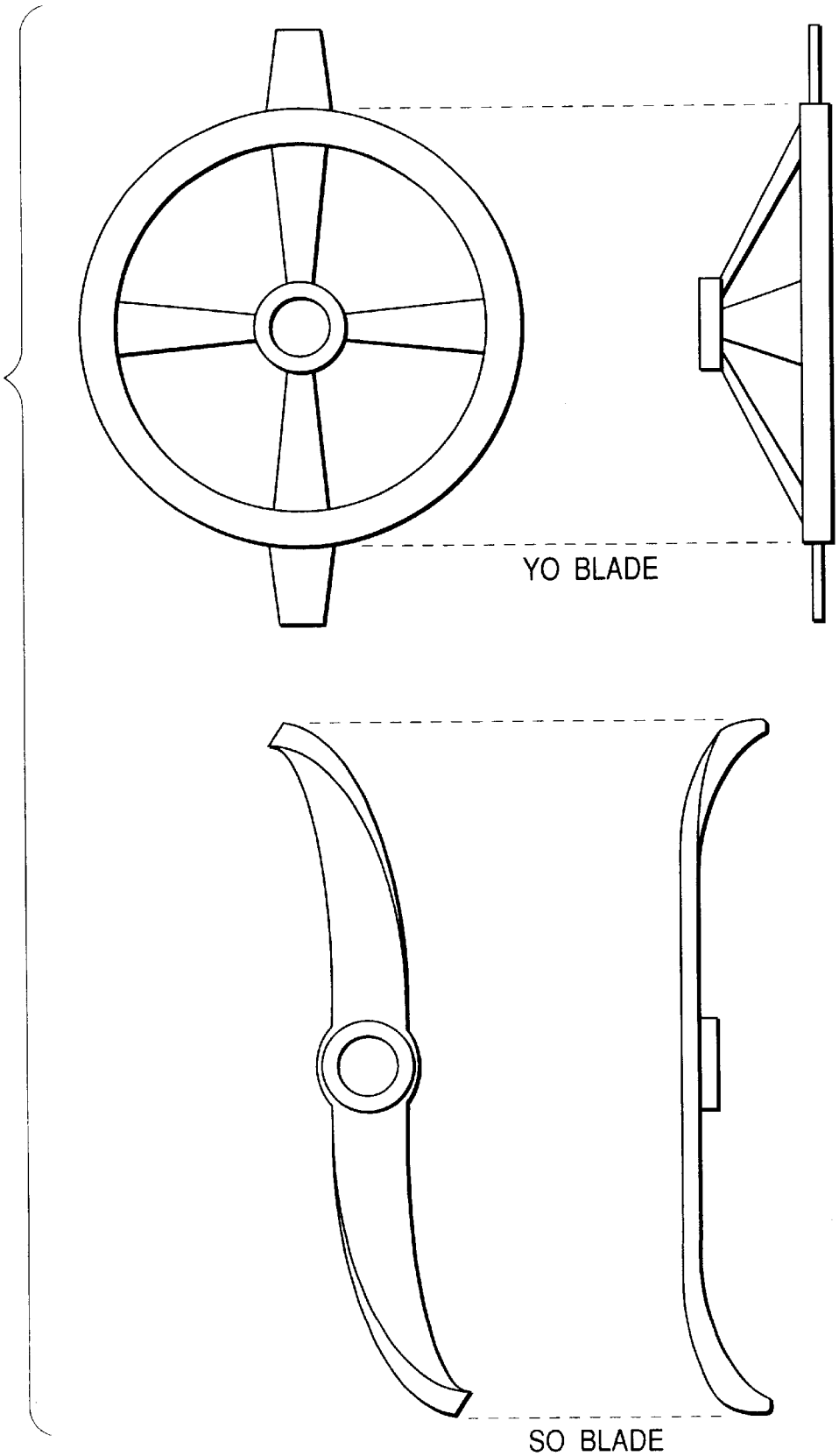
FIG. 9 illustrates examples of an agitating blade used in working examples of the present invention.

To 100 parts by weight of this classified product, 1.2 parts by weight of dry-process silica powder hydrophobic-treated with hexamethyldisilazane and silicone oil was added, and these were mixed to effect external addition by means of Henschel mixer FM10C/I (manufactured by Mitsui & Smelting Co., Ltd.), in which its agitating container was packed with the toner material powder so as to be at an apparent volume packing of 15% and a YO blade and an SO blade as shown in FIG. 9 were used to carry out mixing for 2 minutes at a number of revolutions of 45.00 $s^{-1}$. Thus a toner 1 for evaluation was obtained.

Physical properties of the toner 1 for evaluation thus obtained are shown in Table 1.

The Carr's floodability index and Carr's fluidity index of this toner were 85 and 68, respectively.

Example 2

The powder material A was finely pulverized over a period of 2 hours in the same manner as in Example 1 except that the temperature of the air introduced into the mechanical grinding machine was set at −20° C. and instead the jacket cooling water was stopped flowing. As the result, the temperature T1 in whirl chamber and temperature T2 in rear chamber in the grinding machine were −15° C. and 45° C., respectively, thus the ΔT between T1 and T2 was 60° C. Also, the Tg−T1 was 73° C. and the Tg−T2 was 13° C. The finely pulverized product thus obtained had a weight-average particle diameter of 6.7 μm, and had a sharp particle size distribution, containing 40.8% by number of particles of 4.0 μm or smaller in particle diameter and 3.5% by volume of particles of 10.1 μm or larger in particle diameter.

After the pulverization carried out for 2 hours in the manner described above, the interior of the grinding machine was inspected. As the result, any melt adhesion of toner was not seen in the interior of the grinding machine.

Next, the finely pulverized product obtained was introduced into the multi-division gas current classifier having the construction as shown in FIG. 4, and strictly classified to obtain a classified product having a weight average particle diameter of 6.7 μm and containing 20.6% by number of particles of 4.0 μm or smaller in particle diameter and 2.4% by volume of particles of 10.1 μm or larger in particle diameter. Here, the ratio of the weight of the classified product to the weight of the finely pulverized product, i.e., classification yield, was 85% in weight ratio.

The toner particles having circle-corresponding diameters of 2.0 μm or larger had an average circularity SF-1 of 0.75, an average surface unevenness 1·SF-2 of 1.14 and an average surface unevenness 2·SF-5 of 1.03.

The BET specific surface area Sb per unit volume and theoretical specific surface area St per unit volume of the toner particles were 1.84 $m^2/cm^3$ and 0.90 $m^2/cm^3$, respectively. Therefore, Sb/St was 2.05.

This classified product was subjected to the mixing for external addition in the same manner as in Example 1 to obtain a toner 2 for evaluation.

The Carr's floodability index and Carr's fluidity index of this toner were 86 and 73.5, respectively.

Example 3

The powder material A was finely pulverized over a period of 2 hours in the same manner as in Example 1 except that the temperature of the air introduced into the mechanical grinding machine was set at −5° C. As the result, the temperature T1 in whirl chamber and temperature T2 in rear chamber in the grinding machine were 0° C. and 49° C., respectively, thus the ΔT between T1 and T2 was 49° C. Also, the Tg−T1 was 58° C. and the Tg−T2 was 9° C. The finely pulverized product thus obtained had a weight-average particle diameter of 6.9 μm, and had a sharp particle size distribution, containing 36.6% by number of particles of 4.0 μm or smaller in particle diameter and 4.7% by volume of particles of 10.1 μm or larger in particle diameter.

After the pulverization carried out for 2 hours in the manner described above, the interior of the grinding machine was inspected. As the result, any melt adhesion of toner was not seen in the interior of the grinding machine.

Next, the finely pulverized product obtained was introduced into the multi-division gas current classifier having the construction as shown in FIG. 4, and strictly classified to obtain a classified product having a weight average particle diameter of 6.6 μm and containing 23.3% by number of particles of 4.0 μm or smaller in particle diameter and 1.3% by volume of particles of 10.1 μm or larger in particle diameter. Here, the ratio of the weight of the classified product to the weight of the finely pulverized product, i.e., classification yield, was 83% in weight ratio.

The toner particles having circle-corresponding diameters of 2.0 μm or larger had an average circularity SF-1 of 0.76, an average surface unevenness 1·SF-2 of 1.12 and an average surface unevenness 2·SF-5 of 1.04.

The BET specific surface area Sb per unit volume and theoretical specific surface area St per unit volume of the toner particles were 1.70 $m^2/cm^3$ and 0.91 $m^2/cm^3$, respectively. Therefore, Sb/St was 1.87.

This classified product was subjected to the mixing for external addition in the same manner as in Example 1 to obtain a toner 3 for evaluation.

The Carr's floodability index and Carr's fluidity index of this toner were 84.5 and 66, respectively.

Example 4

The powder material A was finely pulverized over a period of 2 hours in the same manner as in Example 2 except that the temperature of the air introduced into the mechanical grinding machine was set at −5° C., the rotor peripheral speed at 96 m/s and the pulverization feed rate at 50 kg/h. As the result, the temperature T1 in whirl chamber and temperature T2 in rear chamber in the grinding machine were 0° C. and 40° C., respectively, thus the ΔT between T1 and T2 was 40° C. Also, the Tg−T1 was 58° C. and the Tg−T2 was 18° C. The finely pulverized product thus obtained had a weight-average particle diameter of 9.1 μm, and had a sharp particle size distribution, containing 34.6% by number of particles of 4.0 μm or smaller in particle diameter and 34.9% by volume of particles of 10.1 μm or larger in particle diameter.

After the pulverization carried out for 2 hours in the manner described above, the interior of the grinding machine was inspected. As the result, any melt adhesion of toner was not seen in the interior of the grinding machine.

Next, the finely pulverized product obtained was introduced into the multi-division gas current classifier having the construction as shown in FIG. 4, and strictly classified to obtain a classified product having a weight average particle diameter of 9.0 μm and containing 6.1% by number of particles of 4.0 μm or smaller in particle diameter and 30.6% by volume of particles of 10.1 μm or larger in particle diameter. Here, the ratio of the weight of the classified product to the weight of the finely pulverized product, i.e., classification yield, was 85% in weight ratio.

The toner particles having circle-corresponding diameters of 2.0 μm or larger had an average circularity SF-1 of 0.74, an average surface unevenness 1·SF-2 of 1.18 and an average surface unevenness 2·SF-5 of 1.07.

The BET specific surface area Sb per unit volume and theoretical specific surface area St per unit volume of the toner particles were 1.33 $m^2/cm^3$ and 0.67 $m^2/cm^3$, respectively. Therefore, Sb/St was 1.99.

To 100 parts by weight of this classified product, 0.8 part by weight of dry-process silica powder hydrophobic-treated with hexamethyldisilazane and silicone oil was added, and these were mixed to effect external addition by means of Henschel mixer to obtain a toner 4 for evaluation.

The Carr's floodability index and Carr's fluidity index of this toner were 87 and 75, respectively.

Example 5

The powder material A was finely pulverized over a period of 2 hours in the same manner as in Example 1 except that the temperature of the air introduced into the mechanical grinding machine was set at −17° C., the rotor peripheral speed at 137 m/s and the pulverization feed rate at 33 kg/h. As the result, the temperature T1 in whirl chamber and temperature T2 in rear chamber in the grinding machine were −12° C. and 48° C., respectively, thus the ΔT between T1 and T2 was 60° C. Also, the Tg−T1 was 70° C. and the Tg−T2 was 10° C. The finely pulverized product thus obtained had a weight-average particle diameter of 5.7 μm, and had a sharp particle size distribution, containing 43.1% by number of particles of 4.0 μm or smaller in particle diameter and 1.1% by volume of particles of 10.1 μm or larger in particle diameter.

After the pulverization carried out for 2 hours in the manner described above, the interior of the grinding machine was inspected. As the result, any melt adhesion of toner was not seen in the interior of the grinding machine.

Next, the finely pulverized product obtained was introduced into the multi-division gas current classifier having the construction as shown in FIG. 4, and strictly classified to obtain a classified product having a weight average particle diameter of 5.8 μm and containing 33.2% by number of particles of 4.0 μm or smaller in particle diameter and 0.5% by volume of particles of 10.1 μm or larger in particle diameter. Here, the ratio of the weight of the classified product to the weight of the finely pulverized product, i.e., classification yield, was 84% in weight ratio.

The toner particles having circle-corresponding diameters of 2.0 μm or larger had an average circularity SF-1 of 0.76, an average surface unevenness 1·SF-2 of 1.13 and an average surface unevenness 2·SF-5 of 1.04.

The BET specific surface area Sb per unit volume and theoretical specific surface area St per unit volume of the toner particles were 1.95 $m^2/cm^3$ and 1.03 $m^2/cm^3$, respectively. Therefore, Sb/St was 1.89.

To 100 parts by weight of this classified product, 1.5 parts by weight of dry-process silica powder hydrophobic-treated with hexamethyldisilazane and silicone oil was added, and these were mixed to effect external addition by means of Henschel mixer to obtain a toner 5 for evaluation.

The Carr's floodability index and Carr's fluidity index of this toner were 82 and 67.5, respectively.

Example 6

The powder material B was finely pulverized over a period of 2 hours in the same manner as in Example 1 except that the rotor peripheral speed was set at 128 m/s and the pulverization feed rate at 32 kg/h. As the result, the temperature T1 in whirl chamber and temperature T2 in rear chamber in the grinding machine were −10° C. and 43° C., respectively, thus the ΔT between T1 and T2 was 53° C. Also, the Tg−T1 was 70° C. and the Tg−T2 was 17° C. The finely pulverized product thus obtained had a weight-average particle diameter of 6.8 μm, and had a sharp particle size distribution, containing 37.1% by number of particles of 4.0 μm or smaller in particle diameter and 4.1% by volume of particles of 10.1 μm or larger in particle diameter.

After the pulverization carried out for 2 hours in the manner described above, the interior of the grinding machine was inspected. As the result, any melt adhesion of toner was not seen in the interior of the grinding machine.

Next, the finely pulverized product obtained was introduced into the multi-division gas current classifier having the construction as shown in FIG. 4, and strictly classified to obtain a classified product having a weight average particle diameter of 6.7 μm and containing 18.8% by number of particles of 4.0 μm or smaller in particle diameter and 2.5% by volume of particles of 10.1 μm or larger in particle diameter. Here, the ratio of the weight of the classified product to the weight of the finely pulverized product, i.e., classification yield, was 86% in weight ratio.

The toner particles having circle-corresponding diameters of 2.0 μm or larger had an average circularity SF-1 of 0.75, an average surface unevenness 1·SF-2 of 1.14 and an average surface unevenness 2·SF-5 of 1.05.

The BET specific surface area Sb per unit volume and theoretical specific surface area St per unit volume of the toner particles were 1.82 $m^2/cm^3$ and 0.90 $m^2/cm^3$, respectively. Therefore, Sb/St was 2.02.

This classified product was subjected to the mixing for external addition in the same manner as in Example 1 to obtain a toner 6 for evaluation.

The Carr's floodability index and Carr's fluidity index of this toner were 83 and 62.5, respectively.

Example 7

The powder material B was finely pulverized over a period of 2 hours in the same manner as in Example 5 except that the rotor peripheral speed was set at 156 m/s and the pulverization feed rate at 25 kg/h. As the result, the temperature T1 in whirl chamber and temperature T2 in rear chamber in the grinding machine were −12° C. and 52° C., respectively, thus the ΔT between T1 and T2 was 64° C. Also, the Tg−T1 was 72° C. and the Tg−T2 was 8° C. The finely pulverized product thus obtained had a weight-average particle diameter of 5.8 μm, and had a sharp particle size distribution, containing 42.0% by number of particles of 4.0 μm or smaller in particle diameter and 1.4% by volume of particles of 10.1 μm or larger in particle diameter.

After the pulverization carried out for 2 hours in the manner described above, the interior of the grinding machine was inspected. As the result, any melt adhesion of toner was not seen in the interior of the grinding machine.

Next, the finely pulverized product obtained was introduced into the multi-division gas current classifier having the construction as shown in FIG. 4, and strictly classified to obtain a classified product having a weight average particle diameter of 5.8 μm and containing 35.6% by number of particles of 4.0 μm or smaller in particle diameter and 0.6% by volume of particles of 10.1 μm or larger in particle diameter. Here, the ratio of the weight of the classified product to the weight of the finely pulverized product, i.e., classification yield, was 83% in weight ratio.

The toner particles having circle-corresponding diameters of 2.0 μm or larger had an average circularity SF-1 of 0.77, an average surface unevenness 1·SF-2 of 1.11 and an average surface unevenness 2·SF-5 of 1.03.

The BET specific surface area Sb per unit volume and theoretical specific surface area St per unit volume of the toner particles were 1.53 $m^2/cm^3$ and 1.03 $m^2/cm^3$, respectively. Therefore, Sb/St was 1.49.

This classified product was subjected to the mixing for external addition in the same manner as in Example 5 to obtain a toner 7 for evaluation.

The Carr's floodability index and Carr's fluidity index of this toner were 82 and 63.5, respectively.

Example 8

The powder material A was finely pulverized over a period of 2 hours in the same manner as in Example 1 except that, first, the plating was made in a coating thickness of 20 μm, the minimum gap between the rotor and the stator was set at 1.8 mm and the rotor peripheral speed was set at 150 m/s. As the result, the temperature T1 in whirl chamber and temperature T2 in rear chamber in the grinding machine were −10° C. and 41° C., respectively, thus the ΔT between T1 and T2 was 51° C. Also, the Tg−T1 was 68° C. and the Tg−T2 was 17° C. The finely pulverized product, α, thus obtained had a weight-average particle diameter of 6.6 μm, and had a sharp particle size distribution, containing 41.3% by number of particles of 4.0 μm or smaller in particle diameter and 2.9% by volume of particles of 10.1 μm or larger in particle diameter.

After the pulverization carried out for 2 hours in the manner described above, the interior of the grinding machine was inspected. As the result, any melt adhesion of toner was not seen in the interior of the grinding machine.

Next, the finely pulverized product α obtained was introduced into the multi-division gas current classifier having the construction as shown in FIG. 4, and strictly classified to obtain a classified product α having a weight average particle diameter of 6.5 μm and containing 20.6% by number of particles of 4.0 μm or smaller in particle diameter and 1.7% by volume of particles of 10.1 μm or larger in particle diameter. Here, the ratio of the weight of the classified product α to the weight of the finely pulverized product α, i.e., classification yield, was 86% in weight ratio.

The toner particles having circle-corresponding diameters of 2.0 μm or larger had an average circularity SF-1 of 0.74, an average surface unevenness 1·SF-2 of 1.15 and an average surface unevenness 2·SF-5 of 1.07.

The BET specific surface area Sb per unit volume and theoretical specific surface area St per unit volume of the toner particles were 1.94 $m^2/cm^3$ and 0.92 $m^2/cm^3$, respectively. Therefore, Sb/St was 2.11.

This classified product α was subjected to the mixing for external addition in the same manner as in Example 1 to obtain a toner 8α for evaluation.

The Carr's floodability index and Carr's fluidity index of this toner were 83.5 and 62.5, respectively.

Next, the coatings formed by the plating on the rotor and stator were completely removed, and were again formed by plating in the same way but in a coating thickness of 200 μm. Then, the powder material A was finely pulverized over a period of 2 hours in the same manner as in Example 1 except that the minimum gap between the rotor and the stator was set at 1.4 mm and the rotor peripheral speed at 99 m/s. As the result, the temperature T1 in whirl chamber and temperature T2 in rear chamber in the grinding machine were −10° C. and 45° C., respectively, thus the ΔT between T1 and T2 was 55° C. Also, the Tg−T1 was 68° C. and the Tg−T2 was 13° C. The finely pulverized product, β, thus obtained had a weight-average particle diameter of 6.7 μm, and had a sharp particle size distribution, containing 32.6% by number of particles of 4.0 μm or smaller in particle diameter and 3.5% by volume of particles of 10.1 μm or larger in particle diameter.

After the pulverization carried out for 2 hours in the manner described above, the interior of the grinding machine was inspected. As the result, any melt adhesion of toner was not seen in the interior of the grinding machine.

Next, the finely pulverized product β obtained was introduced into the multi-division gas current classifier having the construction as shown in FIG. 4, and strictly classified to obtain a classified product β having a weight average particle diameter of 6.5 μm and containing 22.1% by number of particles of 4.0 μm or smaller in particle diameter and 1.6% by volume of particles of 10.1 μm or larger in particle diameter. Here, the ratio of the weight of the classified product β to the weight of the finely pulverized product β, i.e., classification yield, was 86% in weight ratio.

The toner particles having circle-corresponding diameters of 2.0 μm or larger had an average circularity SF-1 of 0.75, an average surface unevenness 1·SF-2 of 1.14 and an average surface unevenness 2·SF-5 of 1.04.

The BET specific surface area Sb per unit volume and theoretical specific surface area St per unit volume of the toner particles were 1.88 $m^2/cm^3$ and 0.92 $m^2/cm^3$, respectively. Therefore, Sb/St was 2.04.

This classified product β was subjected to the mixing for external addition in the same manner as in Example 1 to obtain a toner 8β for evaluation.

The Carr's floodability index and Carr's fluidity index of this toner were 83 and 62.5, respectively.

It was ascertained by this Example that the minimum gap was in a change by 0.4 mm in the pulverization carried out after the plating was redone, and the same pulverization capacity as that at the first plating was achievable.

Reference Example 1

In this Reference Example, as the rotor and stator of the mechanical grinding machine, a rotor and a stator were used the surfaces of which were coated by nickel plating (surface hardness: HV 500) in a coating thickness of 150 μm, and the minimum gap between the rotor and the stator was set at 1.5 mm. Then, the powder material A was finely pulverized over a period of 2 hours in the same manner as in Example 1 except that the rotor peripheral speed was set at 132 m/s and the pulverization feed rate at 28 kg/h. As the result, the temperature T1 in whirl chamber and temperature T2 in rear chamber in the grinding machine were −10° C. and 45° C., respectively, thus the ΔT between T1 and T2 was 55° C. Also, the Tg−T1 was 68° C. and the Tg−T2 was 13° C. The finely pulverized product thus obtained had a weight-average particle diameter of 6.8 μm, and had a particle size distribution that it contained 45.1% by number of particles of 4.0 μm or smaller in particle diameter and 5.0% by volume of particles of 10.1 μm or larger in particle diameter.

After the pulverization carried out for 2 hours in the manner described above, the interior of the grinding machine was inspected. As the result, any melt adhesion of toner was not seen in the interior of the grinding machine.

Next, the finely pulverized product obtained was introduced into the multi-division gas current classifier having the construction as shown in FIG. 4, and strictly classified to obtain a classified product having a weight average particle diameter of 6.6 μm and containing 21.3% by number of particles of 4.0 μm or smaller in particle diameter and 2.8% by volume of particles of 10.1 μm or larger in particle diameter. Here, the ratio of the weight of the classified product to the weight of the finely pulverized product, i.e., classification yield, was 81% in weight ratio.

The toner particles having circle-corresponding diameters of 2.0 μm or larger had an average circularity SF-1 of 0.75, an average surface unevenness 1·SF-2 of 1.14 and an average surface unevenness 2·SF-5 of 1.03.

The BET specific surface area Sb per unit volume and theoretical specific surface area St per unit volume of the toner particles were 1.82 $m^2/cm^3$ and 0.91 $m^2/cm^3$, respectively. Therefore, Sb/St was 2.00.

This classified product was subjected to the mixing for external addition in the same manner as in Example 1 to obtain a toner 9 for evaluation.

The Carr's floodability index and Carr's fluidity index of this toner were 84.5 and 73, respectively.

Reference Example 2

The powder material B was finely pulverized over a period of 2 hours in the same manner as in Reference Example 1 except that the rotor peripheral speed was set at 142 m/s and the pulverization feed rate at 20 kg/h. As the result, the temperature T1 in whirl chamber and temperature T2 in rear chamber in the grinding machine were −10° C. and 44° C., respectively, thus the ΔT between T1 and T2 was 54° C. Also, the Tg−T1 was 70° C. and the Tg−T2 was 16° C. The finely pulverized product thus obtained had a weight-average particle diameter of 6.8 μm, and had a particle size distribution that it contained 48.4% by number of particles of 4.0 μm or smaller in particle diameter and 5.7% by volume of particles of 10.1 μm or larger in particle diameter.

After the pulverization carried out for 2 hours in the manner described above, the interior of the grinding machine was inspected. As the result, any melt adhesion of toner was not seen in the interior of the grinding machine.

Next, the finely pulverized product obtained was introduced into the multi-division gas current classifier having the construction as shown in FIG. 4, and strictly classified to obtain a classified product having a weight average particle diameter of 6.6 μm and containing 21.5% by number of particles of 4.0 μm or smaller in particle diameter and 3.0% by volume of particles of 10.1 μm or larger in particle diameter. Here, the ratio of the weight of the classified product to the weight of the finely pulverized product, i.e., classification yield, was 78% in weight ratio.

The toner particles having circle-corresponding diameters of 2.0 μm or larger had an average circularity SF-1 of 0.74, an average surface unevenness 1·SF-2 of 1.15 and an average surface unevenness 2·SF-5 of 1.06.

The BET specific surface area Sb per unit volume and theoretical specific surface area St per unit volume of the toner particles were 1.80 $m^2/cm^3$ and 0.91 $m^2/cm^3$, respectively. Therefore, Sb/St was 1.98.

This classified product was subjected to the mixing for external addition in the same manner as in Example 1 to obtain a toner 10 for evaluation.

The Carr's floodability index and Carr's fluidity index of this toner were 86 and 70.5, respectively.

Reference Example 3

The powder material B was finely pulverized over a period of 2 hours in the same manner as in Reference Example 1 except that the temperature of the air introduced into the mechanical grinding machine was set at −17° C., the rotor peripheral speed at 153 m/s and the pulverization feed rate at 12 kg/h. As the result, the temperature T1 in whirl chamber and temperature T2 in rear chamber in the grinding machine were −12° C. and 61° C., respectively, thus the ΔT between T1 and T2 was 73° C. Also, the Tg−T1 was 72° C. and the Tg−T2 was −1° C. The finely pulverized product thus obtained had a weight-average particle diameter of 5.9 μm, and had a particle size distribution that it contained 55.6% by number of particles of 4.0 μm or smaller in particle diameter and 2.1% by volume of particles of 10.1 μm or larger in particle diameter.

After the pulverization carried out for 2 hours in the manner described above, the interior of the grinding machine was inspected. As the result, the melt adhesion of toner was seen in the interior of the grinding machine, chiefly on the rotor and the stator at their part near to the discharge outlet, and any further pulverization was impossible.

Next, the finely pulverized product obtained was introduced into the multi-division gas current classifier having the construction as shown in FIG. 4, and strictly classified to obtain a classified product having a weight average particle diameter of 5.8 μm and containing 34.3% by number of particles of 4.0 μm or smaller in particle diameter and 0.8% by volume of particles of 10.1 μm or larger in particle diameter. Here, the ratio of the weight of the classified product to the weight of the finely pulverized product, i.e., classification yield, was 77% in weight ratio.

The toner particles having circle-corresponding diameters of 2.0 μm or larger had an average circularity SF-1 of 0.79, an average surface unevenness 1·SF-2 of 1.07 and an average surface unevenness 2·SF-5 of 1.03.

The BET specific surface area Sb per unit volume and theoretical specific surface area St per unit volume of the toner particles were 1.41 $m^2/cm^3$ and 1.03 $m^2/cm^3$, respectively. Therefore, Sb/St was 1.37.

This classified product was subjected to the mixing for external addition in the same manner as in Example 1 to obtain a toner 11 for evaluation.

The Carr's floodability index and Carr's fluidity index of this toner were 82 and 63.5, respectively.

Comparative Example 1

In this Comparative Example, as the rotor and stator of the mechanical grinding machine, a rotor and a stator were used the surfaces of which were coated with ceramic by spray coating (surface hardness: HV 1,320) in a coating thickness of 150 μm, and the minimum gap between the rotor and the stator was set at 1.5 mm. Then, the powder material A was finely pulverized over a period of 2 hours in the same manner as in Example 1 except that the rotor peripheral speed was set at 142 m/s and the pulverization feed rate at 25 kg/h. As the result, the temperature T1 in whirl chamber and temperature T2 in rear chamber in the grinding machine were −10° C. and 43° C., respectively, thus the ΔT between T1 and T2 was 53° C. Also, the Tg−T1 was 70° C. and the Tg−T2 was 17° C. The finely pulverized product thus obtained had a weight-average particle diameter of 6.9 μm, and had a particle size distribution that it contained 52.3% by number of particles of 4.0 μm or smaller in particle diameter and 7.0% by volume of particles of 10.1 μm or larger in particle diameter.

After the pulverization carried out for 2 hours in the manner described above, the interior of the grinding machine was inspected. As the result, the melt adhesion of toner was seen in the interior of the grinding machine, chiefly on the rotor and the stator at their part near to the discharge outlet, and any further pulverization was impossible.

Next, the finely pulverized product obtained was introduced into the multi-division gas current classifier having the construction as shown in FIG. 4, and strictly classified to obtain a classified product having a weight average particle diameter of 6.6 μm and containing 20.8% by number of particles of 4.0 μm or smaller in particle diameter and 2.2% by volume of particles of 10.1 μm or larger in particle diameter. Here, the ratio of the weight of the classified product to the weight of the finely pulverized product, i.e., classification yield, was 74% in weight ratio.

The toner particles having circle-corresponding diameters of 2.0 μm or larger had an average circularity SF-1 of 0.74, an average surface unevenness 1·SF-2 of 1.15 and an average surface unevenness 2·SF-5 of 1.04.

The BET specific surface area Sb per unit volume and theoretical specific surface area St per unit volume of the toner particles were 1.85 $m^2/cm^3$ and 0.91 $m^2/cm^3$, respectively. Therefore, Sb/St was 2.03.

This classified product was subjected to the mixing for external addition in the same manner as in Example 1 to obtain a toner 12 for evaluation.

The Carr's floodability index and Carr's fluidity index of this toner were 84 and 66, respectively.

Comparative Example 2

Figure 5:
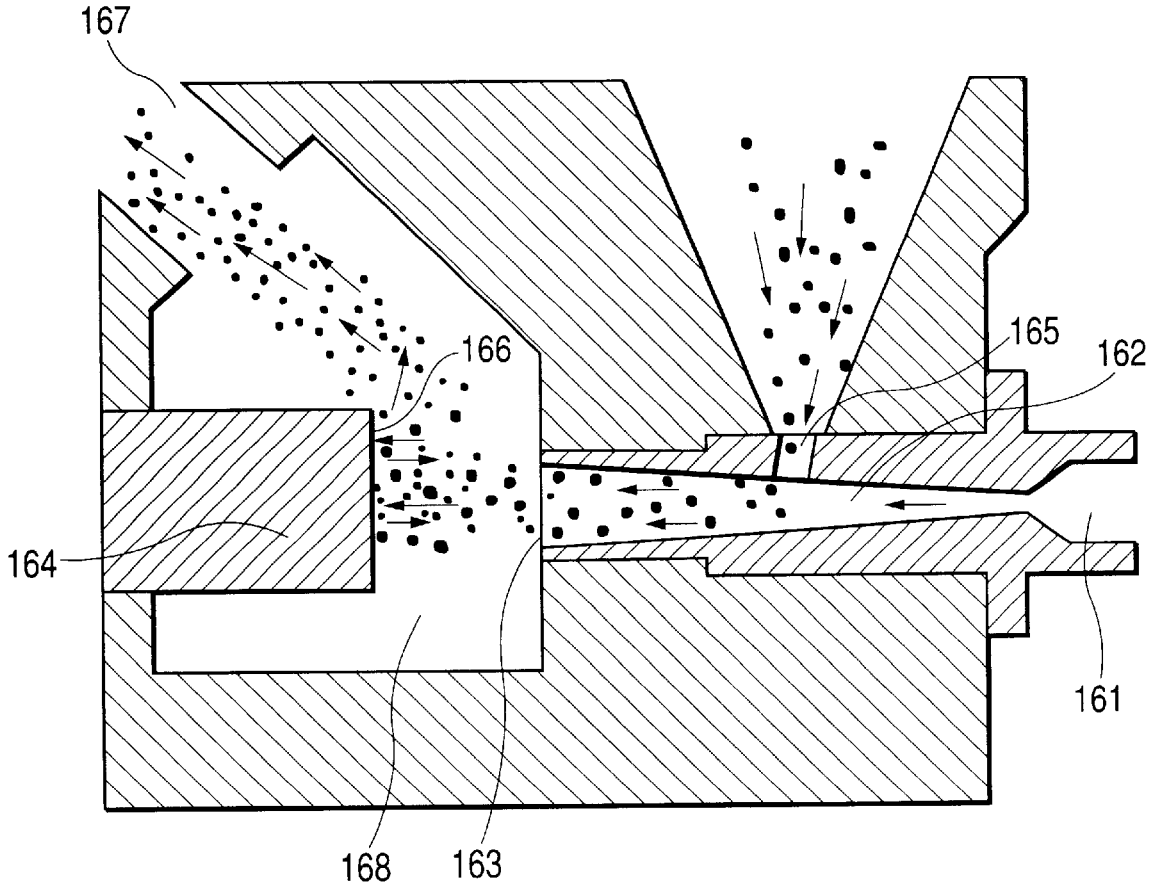
FIG. 5 is a schematic sectional view of a conventional impact jet mill.

The powder material A used in Example 1 was finely pulverized by means of the impact jet mill shown in FIG. 5. The finely pulverized product thus obtained had a weight-average particle diameter of 7.0 μm, and had a particle size distribution that it contained 62.5% by number of particles of 4.0 μm or smaller in particle diameter and 10.4% by volume of particles of 10.1 μm or larger in particle diameter.

After the pulverization was carried out for 2 hours in the manner described above, the interior of the grinding machine was inspected. As the result, any melt adhesion of toner was not seen in the interior of the grinding machine.

Next, the finely pulverized product obtained was introduced into the multi-division gas current classifier having the construction as shown in FIG. 4, and strictly classified to obtain a classified product having a weight average particle diameter of 6.7 μm and containing 21.7% by number of particles of 4.0 μm or smaller in particle diameter and 3.5% by volume of particles of 10.1 μm or larger in particle diameter. Here, the ratio of the weight of the classified product to the weight of the finely pulverized product, i.e., classification yield, was 69% in weight ratio.

The toner particles having circle-corresponding diameters of 2.0 μm or larger had an average circularity SF-1 of 0.71, an average surface unevenness 1·SF-2 of 1.21 and an average surface unevenness 2·SF-5 of 1.09.

The BET specific surface area Sb per unit volume and theoretical specific surface area St per unit volume of the toner particles were 2.53 $m^2/cm^3$ and 0.90 $m^2/cm^3$, respectively. Therefore, Sb/St was 2.81.

This classified product was subjected to the mixing for external addition in the same manner as in Example 1 to obtain a toner 13 for evaluation.

The Carr's floodability index and Carr's fluidity index of this toner were 83 and 62.5, respectively.

Evaluation

In respect of the toners 1 to 13 obtained in the above Examples and Comparative Examples, a printing test was made under the following conditions, using a commercially available laser beam printer LBP-930EX (manufactured by CANON, INC.) which was remodeled to be constructed as described below. When the toner was run out, the toner was replenished through a cutout made at the part of a toner container at the upper part in a cartridge, to continue the printing. Electrostatic latent images were formed setting primary charging at −670 V, and a photosensitive drum and a developer-carrying member (developing sleeve) (holding a magnet internally) were disposed leaving a gap (290 μm) between them so that the developer layer formed on the latter did not come into contact with the former, where as a development bias an AC bias (f: 2,000 Hz; Vpp: 1,600 V) superimposed on a DC bias (Vdc: −500 V) was applied to the developing sleeve. The printer was so remodeled as to have a printing speed of 32 sheets (A4, lateral feed) per minute. Images formed were evaluated on the following items. The results obtained were as shown together in Table 2.

(1) Image Density:

Image density was evaluated by measuring the image density maintained when printing on 25,000 sheets of plain paper (75 $g/m^2$) for usual copying machines was completed in environments of high temperature and high humidity (H/H; 32.5° C., 85% RH) and low temperature and low humidity (L/L; 15° C., 10% RH). The image density was measured with Macbeth Reflection Densitometer (manufactured by Macbeth Co.), as relative density with respect to an image printed on a white ground of an original with a density of 0.00.

(2) Fog:

Fog was calculated from comparison between the whiteness (%) of transfer paper as measured previously with Reflectometer (manufactured by Tokyo Denshoku K.K.) and the whiteness (%) of transfer paper as measured therewith after a solid white image was printed upon finish of print running on 10,000 sheets in the environment of low temperature and low humidity (L/L; 15° C., 10% RH).

Figure 6A:
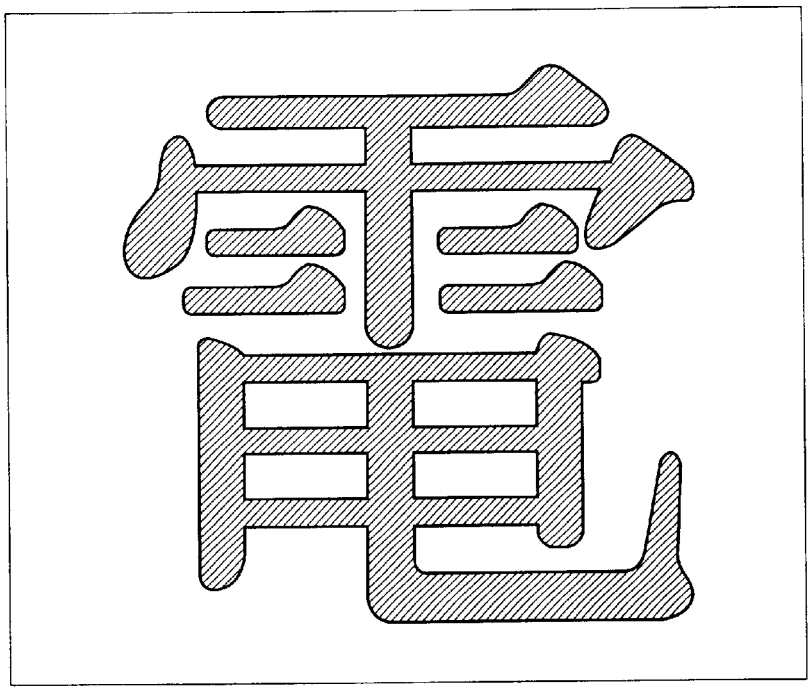
FIGS. 6A and 6B are diagrammatic views showing how spots around line images appear in a character image.
Figure 6B:
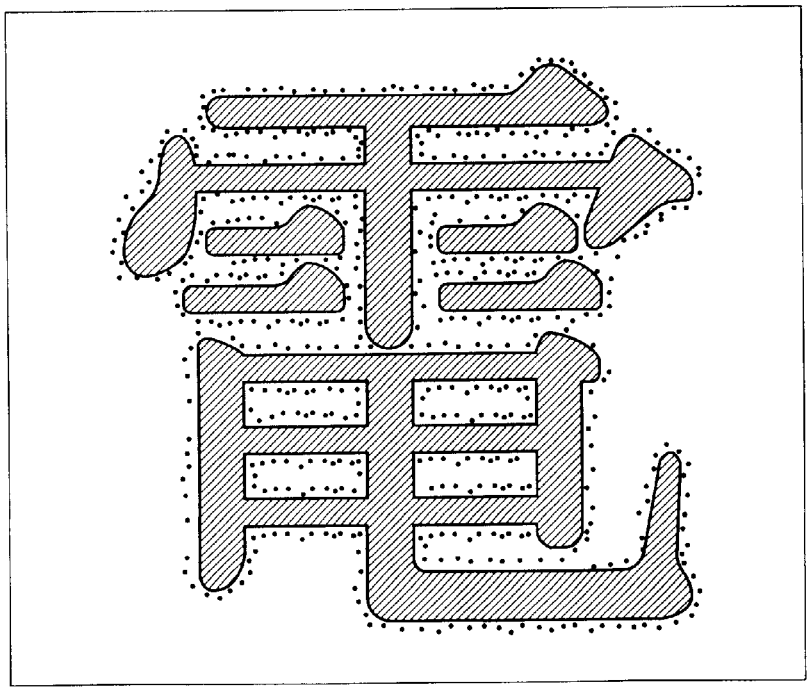

(3) Spots Around Line Images:

The character pattern as shown in FIG. 6A was printed on cardboads (105 $g/m^2$ and 135 $g/m^2$), where any toner spots around line images of the character (the state shown in FIG. 6B) were visually examined to make evaluation.

A: Little occurs.

B: Spots around line images are slightly seen.

C: Spots around line images are seen more or less.

D: Spots around line images are greatly seen.

(4) Transfer Percentage:

In an environment of normal temperature and normal humidity (23° C., 60% RH), 25,000-sheet running was tested, where the percentage of transfer of toner images from an OPC photosensitive drum to transfer paper was determined at the initial stage of running and the latter stage in the following way.

To determine the percentage of transfer of toner images from the OPC photosensitive drum to the transfer paper, toner images (image density: about 1.3) formed on the OPC photosensitive drum were collected on a transparent pressure-sensitive adhesive tape, and their image density was measured with a Macbeth densitometer or a color reflection densitometer (e.g., Color Reflection Densitometer RITE404A, manufactured by X-Rite Co.). Next, toner images were again formed on the OPC photosensitive drum and the toner images were transferred to the transfer paper. The toner images transferred to the transfer paper, corresponding to the toner images collected from the surface of the OPC photosensitive drum, were collected on a transparent pressure-sensitive adhesive tape, and their image density was measured in the same way. The transfer percentage was calculated from the following expression.

Transfer percentage (%)=(Image density of toner image collected from transfer paper surface)/(Image density of toner image collected from *OPC* photosensitive drum surface)×100

TABLE 1

| | | | Example 1 | Example 2 | Example 3 | Example 4 | Example 5 | Example 6 | Example 7 | Example 8 | | Reference Example 1 | Reference Example 2 | Reference Example 3 | Comparative Example 1 | Comparative Example 2 |
|---|---|---|---|---|---|---|---|---|---|---|---|---|---|---|---|---|
| Powder material | Formulation | | A | A | A | A | A | B | B | A | | A | B | B | A | A |
| | Resin Tg(° C.) | | 58 | 58 | 58 | 58 | 58 | 60 | 60 | 60 | | 58 | 60 | 60 | 60 | 58 |
| Pulverization | Apparatus shown in | | | | | | FIG.1 | | | | | | FIG. 1 | | FIG. 1 | FIG. 5 |
| | Wear-resistent treatment of rotor and stator | | | | | Plating of chromium alloy cont. chromium carbide | | | | | | | Nickel plating | | Spray coat. | |
| | Vickers hardness | | | | | | HV1,050 | | | | | | HV500 | | HV1,320 | |
| | Wear-resistant-layer thickness (μm) | | | | | 150 | | | | 20 | 200 | | 150 | | 150 | |
| | Minimum gap between rotor and stator (mm) | | | | | 1.5 | | | | 1.8 | 1.4 | | 1.5 | | 1.5 | |
| | Peripheral speed (m/s) | | 110 | 110 | 110 | 96 | 137 | 128 | 156 | 150 | 99 | 132 | 142 | 153 | 142 | |
| | Feed rate (kg/h) | | 40 | 40 | 40 | 50 | 33 | 32 | 25 | 40 | 40 | 28 | 20 | 12 | 25 | |
| | Cold-air temperature (° C.) | | −15 | −20 | −5 | −5 | −17 | −15 | −17 | −15 | −15 | −15 | −15 | −17 | −15 | |
| | Front-chamber temp. T1 (° C.) | | −10 | −15 | 0 | 0 | −12 | −10 | −12 | −10 | −10 | −10 | −10 | −12 | −10 | |
| | Rear-chamber temp.T2 ° C.) | | 43 | 45 | 49 | 40 | 48 | 43 | 52 | 41 | 45 | 45 | 44 | 61 | 43 | |
| | Δ T(=T2-T1,° C.) | | 53 | 60 | 49 | 40 | 60 | 53 | 64 | 51 | 55 | 55 | 54 | 73 | 53 | |
| | Tg-T1 (° C.) | | 68 | 73 | 58 | 58 | 70 | 70 | 72 | 68 | 68 | 68 | 70 | 72 | 70 | |
| | Tg-T2 (° C.) | | 15 | 13 | 9 | 18 | 10 | 17 | 8 | 17 | 13 | 13 | 16 | −1 | 17 | |
| | Jacket cooling water | | yes | no | yes | no | yes | yes | yes | yes | yes | yes | yes | yes | yes | |
| | Toner melt adhesion in grinding machine | | no | no | no | no | no | no | no | no | no | no | no | yes | yes | no |
| | Particle size distribution | Weight-average particle diameter (μm) | 6.6 | 6.7 | 6.9 | 9.1 | 5.7 | 6.8 | 5.8 | 6.6 | 6.7 | 6.8 | 6.8 | 5.9 | 6.9 | 7.0 |
| | | 4.0 μm or smaller (% by number) | 33.2 | 40.8 | 36.6 | 34.6 | 43.1 | 37.1 | 42.0 | 41.3 | 32.6 | 45.1 | 48.4 | 55.6 | 52.3 | 62.5 |
| | | 10.1 μm or larger (% by volume) | 3.1 | 3.5 | 4.7 | 34.9 | 1.1 | 4.1 | 1.4 | 2.9 | 3.5 | 5.0 | 5.7 | 2.1 | 7.0 | 10.4 |
| Classification | Classifier shown in | | | | | | FIG. 4 | | | | | | FIG. 4 | | FIG. 4 | |
| | Particle size distribution | Weight average particle diameter (μm) | 6.5 | 6.7 | 6.6 | 9.0 | 5.8 | 6.7 | 5.8 | 6.5 | 6.5 | 6.6 | 6.6 | 5.8 | 6.6 | 6.7 |
| | | 4.0 μm or smaller (% by number) | 21.2 | 20.6 | 23.3 | 6.1 | 33.2 | 18.8 | 35.6 | 20.6 | 22.1 | 21.3 | 21.5 | 34.3 | 20.8 | 21.7 |
| | | 10.1 μm or larger (% by volume) | 1.1 | 2.4 | 1.3 | 30.6 | 0.5 | 2.5 | 0.6 | 1.7 | 1.6 | 2.8 | 3.0 | 0.8 | 2.2 | 3.5 |
| | Shape factors | Average circulanty SF-1 | 0.75 | 0.75 | 0.76 | 0.74 | 0.76 | 0.75 | 0.77 | 0.74 | 0.75 | 0.75 | 0.74 | 0.79 | 0.74 | 0.71 |
| | | Average surface unevenness | 1.13 | 1.14 | 1.12 | 1.18 | 1.13 | 1.14 | 1.11 | 1.15 | 1.14 | 1.14 | 1.15 | 1.07 | 1.15 | 1.21 |

TABLE 1-continued

| | | | Example 1 | Example 2 | Example 3 | Example 4 | Example 5 | Example 6 | Example 7 | Example 8 | | Reference Example 1 | Reference Example 2 | Reference Example 3 | Comparative Example 1 | Comparative Example 2 |
|---|---|---|---|---|---|---|---|---|---|---|---|---|---|---|---|---|
| | | 1.SF-2 Average surface unevenness 2.SF-5 | 1.04 | 1.03 | 1.04 | 1.07 | 1.04 | 1.06 | 1.03 | 1.07 | 1.04 | 1.03 | 1.06 | 1.03 | 1.04 | 1.09 |
| | Specific gravity | | 1.7 | 1.7 | 1.7 | 1.7 | 1.7 | 1.7 | 1.7 | 1.7 | 1.7 | 1.7 | 1.7 | 1.7 | 1.7 | 1.7 |
| | BET . Sb per volume($m^2/cm^3$) | | 1.87 | 1.84 | 1.70 | 1.33 | 1.95 | 1.82 | 1.53 | 1.94 | 1.88 | 1.82 | 1.80 | 1.41 | 1.85 | 2.53 |
| | Theoretical . St per volume ($m^2/cm^3$) | | 0.92 | 0.90 | 0.91 | 0.67 | 1.03 | 0.90 | 1.03 | 0.92 | 0.92 | 0.91 | 0.91 | 1.03 | 0.91 | 0.90 |
| | Sb/St | | 2.03 | 2.05 | 1.87 | 1.99 | 1.89 | 2.02 | 1.49 | 2.11 | 2.04 | 2.00 | 1.98 | 1.37 | 2.03 | 2.81 |
| | Classification yield (wt %) | | 87 | 85 | 83 | 85 | 84 | 86 | 83 | 86 | 86 | 81 | 78 | 77 | 74 | 69 |
| Toner | Floodability index | | 85 | 86 | 84.5 | 87 | 82 | 83 | 82 | 83.5 | 83 | 84.5 | 86 | 82 | 84 | 83 |
| | Fluidity index | | 68 | 73.5 | 66 | 75 | 67.5 | 62.5 | 63.5 | 62.5 | 62.5 | 73 | 70.5 | 63.5 | 66 | 62.5 |
| | Particle size distribution | Weight-average particle diameter($\mu$m) | 6.5 | 6.7 | 6.6 | 9.0 | 5.8 | 6.7 | 5.8 | 6.5 | 6.5 | 6.6 | 6.6 | 5.8 | 6.6 | 6.7 |
| | | 40 $\mu$m or smaller (% by number) | 21.2 | 20.6 | 23.3 | 6.1 | 33.2 | 18.8 | 35.6 | 20.6 | 22.1 | 21.3 | 21.5 | 34.3 | 20.8 | 21.7 |
| | | 10.1 $\mu$m or larger (% by volume) | 1.1 | 2.4 | 1.3 | 30.6 | 0.5 | 2.5 | 0.6 | 1.7 | 1.6 | 2.8 | 3.0 | 0.8 | 2.2 | 3.5 |
| | Shape Factors | Average circulanty SF-1 | 0.74 | 0.75 | 0.76 | 0.73 | 0.76 | 0.75 | 0.77 | 0.74 | 0.74 | 0.75 | 0.74 | 0.78 | 0.74 | 0.71 |
| | | Average surface unevenness 1.SF-2 | 1.13 | 1.14 | 1.13 | 1.18 | 1.13 | 1.14 | 1.11 | 1.15 | 1.14 | 1.15 | 1.15 | 1.07 | 1.15 | 1.21 |
| | | Average surface unevenness 2.SF-5 | 1.04 | 1.03 | 1.04 | 1.07 | 1.04 | 1.05 | 1.03 | 1.07 | 1.04 | 1.03 | 1.06 | 1.03 | 1.04 | 1.09 |
| | Specific gravity | | 1.7 | 1.7 | 1.7 | 1.7 | 1.7 | 1.7 | 1.7 | 1.7 | 1.7 | 1.7 | 1.7 | 1.7 | 1.7 | 1.7 |
| | BET .Sb per volume ($m^2/cm^3$) | | 3.74 | 3.71 | 3.57 | 2.52 | 4.33 | 3.69 | 3.91 | 3.81 | 3.75 | 3.69 | 3.67 | 3.79 | 3.72 | 4.40 |
| | Theoretical . St per volume ($m^2/cm^3$) | | 0.92 | 0.90 | 0.91 | 0.67 | 1.030.90 | 1.03 | 0.92 | 0.91 | 0.91 | 1.03 | 0.91 | 0.90 | | |
| | Sb/St | | 4.07 | 4.12 | 3.92 | 3.76 | 4.20 | 4.10 | 3.80 | 4.14 | 4.08 | 4.05 | 4.03 | 3.68 | 4.09 | 4.89 |

TABLE 2

| | | Example 1 | Example 2 | Example 3 | Example 4 | Example 5 | Example 6 | Example 7 | Example 8 | | Reference Example 1 | Reference Example 2 | Reference Example 3 | Comparative Example 1 | Comparative Example 2 |
|---|---|---|---|---|---|---|---|---|---|---|---|---|---|---|---|
| Toner | | 1 | 2 | 3 | 4 | 5 | 6 | 7 | 8α | 8β | 9 | 10 | 11 | 12 | 13 |
| Image density | Initial stage in H/H | 1.48 | 1.47 | 1.48 | 1.48 | 1.47 | 1.49 | 1.48 | 1.48 | 1.47 | 1.44 | 1.45 | 1.45 | 1.45 | 1.43 |
| | 25,000 sheets in H/H | 1.45 | 1.46 | 1.45 | 1.46 | 1.46 | 1.45 | 1.47 | 1.45 | 1.45 | 1.37 | 1.39 | 1.39 | 1.33 | 1.16 |
| | Initial stage in L/L | 1.50 | 1.51 | 1.49 | 1.47 | 1.49 | 1.47 | 1.47 | 1.48 | 1.49 | 1.45 | 1.45 | 1.45 | 1.44 | 1.45 |
| | 25,000 sheets in L/L | 1.48 | 1.49 | 1.46 | 1.45 | 1.47 | 1.45 | 1.45 | 1.46 | 1.45 | 1.38 | 1.44 | 1.42 | 1.39 | 1.41 |
| Fog (%) | Initial stage in L/L | 0.8 | 1.3 | 1.0 | 1.5 | 1.3 | 1.4 | 1.2 | 1.0 | 1.2 | 1.8 | 1.2 | 2.2 | 2.5 | 1.7 |
| | 25,000 sheets in L/L | 1.5 | 1.6 | 1.3 | 1.8 | 1.6 | 1.7 | 1.9 | 1.4 | 1.5 | 2.5 | 2.1 | 3.0 | 3.3 | 4.4 |
| Spots around line images | | A | A | A | A | A | A | A | A | A | B | B | C | D | C |
| Transfer percentage (%) | | 95 | 95 | 94 | 95 | 92 | 94 | 92 | 94 | 94 | 91 | 91 | 86 | 88 | 81 |

What is claimed is:

1. A toner production process comprising the steps of:

melt-kneading a mixture containing at least a binder resin and a colorant to obtain a kneaded product;

cooling the kneaded product to obtain a cooled product;

crushing the cooled product to obtain a crushed product;

pulverizing a powder material comprising the crushed product, by means of a grinding means to obtain a pulverized product; and classifying the pulverized product by a classifying means;

wherein;

said grinding means comprises a mechanical grinding machine having at least a rotor which is a rotator attached to the center rotating shaft and a stator which is provided around the rotor, and keeping a constant gap between the stator and the rotor surface; and the surface of at least one of the rotor and the stator is coated by a plating of a chromium alloy containing at least chromium carbide.

2. The toner production process according to claim 1, wherein at least one of the rotor and the stator has a surface hardness of from HV 900 to HV 1,300 (Vickers hardness 900 to 1,300).

3. The toner production process according to claim 1, wherein, in the toner particles having been classified, toner particles having particle diameters of 2.0 μm or larger as circle-corresponding diameter have an average circularity SF-1 of from 0.73 to 0.90, an average surface unevenness 1·SF-2 of from 1.07 to 1.20 and an average surface unevenness 2·SF-5 of from 1.03 to 1.08.

4. The toner production process according to claim 3, wherein the average circularity SF-1 of the toner particles having been classified is from 0.74 to 0.80.

5. The toner production process according to claim 1, wherein, in the toner particles having been classified, the relationship between specific surface area Sb per unit volume ($m^2/cm^3$) as measured by the BET method and specific surface area St per unit volume ($m^2/cm^3$) as calculated from weight-average particle diameter when toner particles are assumed to be true spheres fulfills the following condition:

$$Sb/St<2.5.$$

6. The toner production process according to claim 1, wherein, in said toner, toner having particle diameters of 2.0 μm or larger as circle-corresponding diameter has an average circularity SF-1 of from 0.71 to 0.90, an average surface unevenness 1·SF-2 of from 1.07 to 1.22 and an average surface unevenness 2·SF-5 of from 1.03 to 1.10.

7. The toner production process according to claim 6, wherein the average circularity SF-1 of said toner is from 0.72 to 0.80.

8. The toner production process according to claim 1, wherein said toner is a magnetic toner containing a magnetic material in an amount of from 40 parts by weight to 200 parts by weight based on 100 parts by weight of the binder resin.

9. The toner production process according to claim 1, wherein said toner has a Carr's floodability index in a value of more than 80.

10. The toner production process according to claim 1, wherein said toner has a Carr's fluidity index in a value of more than 60.

11. The toner production process according to claim 1, wherein a plated component having worn or come off is removed and at least one of the rotor and stator is again coated by said plating, and the powder material is pulverized keeping a circular space formed by the gap at a constant volume.

12. The toner production process according to claim 1, wherein the powder material is pulverized setting the gap between the rotor and the stator in a minimum gap of from 0.5 mm to 10.0 mm.

13. The toner production process according to claim 1, wherein a coating layer formed by said plating has a thickness of from 20 μm to 300 μm.

14. The toner production process according to claim 1, wherein the minimum gap between the rotor and the stator has a variation width of 0.5 mm or smaller.

15. The toner production process according to claim 1, wherein said powder material is introduced in said grinding machine together with air of +30° C. or below.

16. The toner production process according to claim 1, wherein said air has a temperature of from +20° C. to −40° C.

17. The toner production process according to claim 1, wherein said mechanical grinding machine has a whirl chamber communicating with a powder material feed opening, and the whirl chamber has a chamber temperature T1 of +20° C. or below.

18. The toner production process according to claim 17, wherein said whirl chamber has a chamber temperature T1 of from +10° C. to −30° C.

19. The toner production process according to claim 1, wherein a pulverized product formed in said mechanical grinding machine is discharged to the outside of the grinding machine from a powder discharge opening through a rear chamber of said mechanical grinding machine, and the rear chamber has a chamber temperature T2 of from 30° C. to 60° C.

20. The toner production process according to claim 19, wherein said mechanical grinding machine has a whirl chamber communicating with a powder material feed opening, the whirl chamber has a chamber temperature T1, and said chamber temperature T1 and said chamber temperature T2 has a temperature difference ΔT (T2−T1) of from 30° C. to 80° C.

21. The toner production process according to claim 20, wherein said chamber temperature T1 and said chamber temperature T2 has a temperature difference ΔT (T2−T1) of from 35° C. to 70° C.

22. The toner production process according to claim 17, wherein said binder resin has a glass transition temperature Tg of from 45° C. to 75° C., and said chamber temperature T1 at the whirl chamber in said mechanical grinding machine is kept at +20° C. or below and is temperature-controlled to be lower by 40° C. to 80° C. than the glass transition temperature Tg of the binder resin.

23. The toner production process according to claim 19, wherein said binder resin has a glass transition temperature Tg of from 45° C. to 75° C., and said chamber temperature T2 at the rear chamber in the mechanical grinding machine is temperature-controlled to be lower by 0° C. to 30° C. than the glass transition temperature Tg of the binder resin.

24. The toner production process according to claim 1, wherein said mechanical grinding machine has a jacket for in-machine cooling, and the powder material is pulverized with passing cooling water through the interior of the jacket.

* * * * *

UNITED STATES PATENT AND TRADEMARK OFFICE

CERTIFICATE OF CORRECTION

PATENT NO. : 6,673,506 B2
DATED : January 6, 2004
INVENTOR(S) : Tsuneo Nakanishi et al.

It is certified that error appears in the above-identified patent and that said Letters Patent is hereby corrected as shown below:

Column 2,
Line 37, “also” should read -- also be --;
Line 50, “refer” should read -- refer to --; and
Line 63, “so” should read -- such a --.

Column 3,
Line 11, “has,” should read -- have --.

Column 4,
Line 59, “ultrahigh-speed” should read -- ultra high-speed --.

Column 5,
Line 44, “Cr —Mo” should read -- Cr-Mo --.

Column 9,
Line 21, “Keeping the” should read -- Keeping --; and
Line 54, “Method” should read -- Method: --.

Column 11,
Line 20, “$1=L^2/4\times\pi\times A)$” should read -- $1=L^2/(4\times\pi\times A)$ --.

Column 12,
Line 55, “chargeabiliry” should read -- chargeability --.

Column 13,
Line 22, “been” should read -- be --;
Line 48, “Repose” should read -- Repose: --;
Line 56, “Compression” should read -- Compression: --;
Line 63, “Gravity” should read -- Gravity: --; and
Line 65, “After the” should read -- After --.

Column 14,
Line 3, “Gravity” should read -- Gravity: --;
Line 15, “Angle” should read -- Angle: --;
Line 28, “Agglomeration” should read -- Agglomeration: --;
Line 45, “Rupture)” should read -- Rupture): --;
Line 52, “Angle” should read -- Angle: --; and
Line 55, “Dispersability” should read -- Dispersability: --.

UNITED STATES PATENT AND TRADEMARK OFFICE

CERTIFICATE OF CORRECTION

PATENT NO. : 6,673,506 B2
DATED : January 6, 2004
INVENTOR(S) : Tsuneo Nakanishi et al.

It is certified that error appears in the above-identified patent and that said Letters Patent is hereby corrected as shown below:

Column 18,
Line 7, “mount” should read -- amount --; and
Line 39, “may” should read -- may be --.

Column 21,
Line 31, “includes” should read -- include --.

Column 28,
Line 24, “flied” should read -- flown --; and
Line 35, “it is” should read -- is --.

Column 37,
Line 51, “$1.03m^2/cm^{3,}$” should read -- $1.03m^2/cm^3$, --.

Column 40,
Line 14, “cardboads” should read -- cardboards --.

Column 41-44,
Table 1, “°C.)” should read -- (°C.) --;
Table 1, “circulanty” should read -- circularity --;
Table 1, “1.SF-2” should read -- 1•SF-2 --;
Table 1, “1.06” should read -- 1.05 --;
Table 1, “2.SF-5” should read -- 2•SF-5 --;
Table 1, “BET. Sb” should read -- BET• Sb --;
Table 1, “Theoretical . St” should read -- Theoretical • St --;
Table 1, “circulanty” should read -- circularity --;
Table 1, “1.SF-2” should read -- 1•SF-2 --;
Talbe 1, “1.05” should read -- 1.06 --
Table 1, “2.SF-5” should read -- 2•SF-5 --

Column 41-44,
Table 1, “BET. Sb” should read -- BET• Sb --;
Table 1, “Theoretical . St” should read -- Theoretical • St --;
Table 1, example 5, “1.030.90” should read -- 1.031;
Table 1, example 6, “1.03” should read -- 0.90 --;
Table 1, example 7, “0.92” should read -- 1.03 --;
Table 1 , example 8, “0.91” should read -- 0.92--;
Table 1, example 9, “0.91” should read -- 0.92 --;
Table 1, reference example 1, “1.03” should read -- 0.91 --;

UNITED STATES PATENT AND TRADEMARK OFFICE

CERTIFICATE OF CORRECTION

PATENT NO. : 6,673,506 B2
DATED : January 6, 2004
INVENTOR(S) : Tsuneo Nakanishi et al.

It is certified that error appears in the above-identified patent and that said Letters Patent is hereby corrected as shown below:

Column 41-44, Table 1 (cont'd.)
Table 1, reference example 3, "0.90" should read -- 1.03 --;
Table 1, comparative example 1, "  " should read -- 0.91 --; and
Table 1, comparative example 2, "  " should read -- 0.90 --.

Signed and Sealed this

Third Day of August, 2004

JON W. DUDAS
*Acting Director of the United States Patent and Trademark Office*